US012523052B2

(12) United States Patent
Ramos et al.

(10) Patent No.: US 12,523,052 B2
(45) Date of Patent: Jan. 13, 2026

(54) SYSTEMS AND METHODS FOR POOL FRAMES AND LINERS

(71) Applicant: BELGRAVIA WOOD LIMITED, Hong Kong (CN)

(72) Inventors: Jaime Ramos, Moorpark, CA (US); Wei Gu, Dale City, CA (US); Elliot Lucas Ortiz, San Francisco, CA (US); Daniel Kendall Harden, Carmel-by-the-Sea, CA (US)

(73) Assignee: Belgravia Wood Limited, Central (HK)

( * ) Notice: Subject to any disclaimer, the term of this patent is extended or adjusted under 35 U.S.C. 154(b) by 383 days.

(21) Appl. No.: 18/041,979

(22) PCT Filed: Aug. 17, 2021

(86) PCT No.: PCT/US2021/046364
§ 371 (c)(1),
(2) Date: Feb. 16, 2023

(87) PCT Pub. No.: WO2022/040227
PCT Pub. Date: Feb. 24, 2022

(65) Prior Publication Data

US 2023/0323692 A1 Oct. 12, 2023

Related U.S. Application Data

(60) Provisional application No. 62/706,598, filed on Aug. 27, 2020, provisional application No. 63/066,626, filed on Aug. 17, 2020.

(51) Int. Cl.
*E04H 4/00* (2006.01)
*E04H 4/14* (2006.01)

(52) U.S. Cl.
CPC ..... *E04H 4/0056* (2013.01); *E04H 2004/146* (2013.01)

(58) Field of Classification Search
CPC ..... E04H 2004/146
See application file for complete search history.

(56) References Cited

U.S. PATENT DOCUMENTS 2,580,942 A 1/1952 Murad et al.
5,083,327 A * 1/1992 Gillebaard ..... E04H 4/0056 220/4.16

(Continued)

OTHER PUBLICATIONS

International Search Report and Written Opinion dated Jan. 5, 2022, PCT/US2021/046364 (12 pages).

(Continued)

*Primary Examiner* — Lauren A Crane
(74) *Attorney, Agent, or Firm* — Finnegan, Henderson, Farabow, Garrett & Dunner LLP

(57) ABSTRACT

A frame for a pool that may be installed as a series of links is disclosed. The series of links may be configured to connect to one or more other links. One or more links may be extendable from a collapsed configuration to an extended configuration. A first link of the one or more links may be configured to connect to a second link of the one or more links. An extendable portion of the first link may connect to a connecting member of the second link. The first link may include a first frame member that pivots relative to a second frame member. The pool may include a liner that is installed on the frame of the pool. The liner may attach to the frame by passing above and around one or more frame members.

20 Claims, 30 Drawing Sheets

(56) References Cited

U.S. PATENT DOCUMENTS

| | | | | |
|---|---|---|---|---|
| 6,412,122 | B1 | 7/2002 | Foy et al. | |
| 6,742,198 | B2 | 6/2004 | Lee | |
| 2001/0037620 | A1 | 11/2001 | Choi | |
| 2015/0096980 | A1* | 4/2015 | Laing | B65D 90/24 220/9.4 |
| 2019/0093376 | A1* | 3/2019 | Liu | E04H 4/0056 |

OTHER PUBLICATIONS

Extended European Search Report dated Mar. 7, 2025, EP21858999.2 (12 pages).

* cited by examiner

SYSTEMS AND METHODS FOR POOL FRAMES AND LINERS

CROSS REFERENCES TO RELATED APPLICATIONS

This application is the National Phase of PCT International Application No. PCT/US2021/046364, filed on Aug. 17, 2021, which claims the benefit of U.S. Provisional Application No. 63/066,626 filed on Aug. 17, 2020 and U.S. Provisional Application No. 62/706,598 filed on Aug. 27, 2020. The entire contents of the above-referenced applications are incorporated herein by reference.

FIELD

The present disclosure relates generally to pools, including apparatus, systems, and methods for installing pools.

BACKGROUND

A pool frame supports a pool liner that contains water in a determined volume and provides the support to hold water against the weight of the water and the liner. An above-ground pool takes advantage of avoiding the cost and effort involved with digging or otherwise excavating a space for a pool. Additionally, above-ground pools take advantage of being installed in locations where digging or excavating is impracticable or impossible. Frames are heavy and difficult to transport effectively. Thus, it is desired to have a pool frame that is easily installable, is secure against the weight of the water, and where the installation is efficient and repeatable.

A pool liner ideally contains water in a determined volume against the weight of the held water and without leaking. An above-ground pool takes advantage of avoiding the cost and effort involved with digging or otherwise excavating a space for a pool. Additionally, above-ground pools take advantage of being installed in locations where digging or excavating is impracticable or impossible.

The frame and the liner may be installed as an intertwined unit. One or more frame members may be laced through one or more sleeves in the liner as the pool is being constructed. During disassembly for maintenance or to move the pool, the frame members may be disconnected as a section or individually to remove the frame members from the sleeves. In a different location, the frame members may be reconnected and laced through one or more sleeves in the liner.

SUMMARY

An exemplary aspect of this disclosure relates to a frame for a pool may be installed as a series of links. One or more links may be configured to connect to one or more other links to form the frame of the pool. One or more links may be extendable from a collapsed configuration to an extended configuration. A first link of the one or more links may be configured to connect to a second link of the one or more links. An extendable portion of the first link may connect to a connecting member of the second link. The first link may include a first frame member that pivots relative to a second frame member. The second frame member may include an insert that fits within the first frame member to lock the frame members.

An exemplary aspect of this disclosure relates to a pool comprising a frame including one or more frame members; and a pool liner including one or more flaps, wherein the pool liner extends from below one or more frame members to above and around one or more frame members; wherein one or more flaps comprises an attachment aperture and one or more frame members comprises a protruding portion; wherein the attachment aperture is configured to attach to the protruding portion on one or more frame members.

An exemplary aspect of this disclosure relates to a pool comprising, a frame including one or more vertical frame members and at least one horizontal frame member; and a pool liner including one or more pockets, wherein the pool liner extends from below the at least one horizontal frame member and to above the at least one horizontal frame member; wherein a plurality of pockets are spaced along a circumference of the pool liner; wherein each of the plurality of pockets are configured to receive the one or more vertical frame members.

It is to be understood that both the foregoing general description and the following detailed description are exemplary and explanatory only and are not restrictive of the invention. The accompanying drawings, which are incorporated in and constitute a part of this specification, illustrate several exemplary embodiments and together with the description, serve to outline principles of the exemplary embodiments.

It is to be understood that both the foregoing general description and the following detailed description are exemplary and explanatory only and are not restrictive of the scope of the invention.

DETAILED DESCRIPTION

Reference will now be made in detail to exemplary embodiments, some examples of which are shown in the accompanying drawings.

Exemplary disclosed embodiments include apparatus, systems, and methods for installing a pool. For example, in some embodiments, a pool liner may be installed within a volume within a frame. The liner may include a polymer that extends below and around a volume of water. The liner may be connected to the frame to contain the water. The frame may form a shape to contain water within the shape. In some embodiments, the shape of the frame may be circular. The disclosed embodiments provide for a secure, replicable installation.

Exemplary disclosed embodiments include apparatus, systems, and methods for installing a pool liner. For example, in some embodiments, a pool liner may be installed within a volume within a frame. The liner may include a polymer that extends below and around a volume of water. The liner may be connected to the frame to contain the water. In some embodiments, the liner may extend from below the frame and pass over the frame. In some embodiments, the liner may be attachable to the frame or the liner after extending above the frame. In some embodiments, the liner may include a flap that extends over the frame. In some embodiments, the flap may be attachable to the frame or the liner after extending above the frame. The disclosed embodiments allow for simplified installation and maintenance of the frame and the pool liner. The disclosed embodiments increase resistance to leaking and provide for a secure, replicable installation.

Exemplary embodiments may include a fastener configured to connectedly attach a liner after extending above one or more frame members.

FIGS. 1A-1B, 2A-2C, 3A-3C, 4, 5A-5B, 6A-6B, 7A-7C, and 8A-8B illustrate non-limiting examples of a pool frame consistent with the present disclosure. FIGS. 9, 10A-10M, 11A-11F, 13A-13D, and 14 illustrate non-limiting examples of a pool liner consistent with the present disclosure. FIG. 12 illustrates a non-limiting example of a pool liner connection consistent with the present disclosure. FIG. 15 illustrates a non-limiting example of a pool assembly method consistent with the present disclosure. It is understood that the examples and embodiments described represent simplified descriptions used to facilitate understanding of the principles and methods of this disclosure.

Figure 1A:
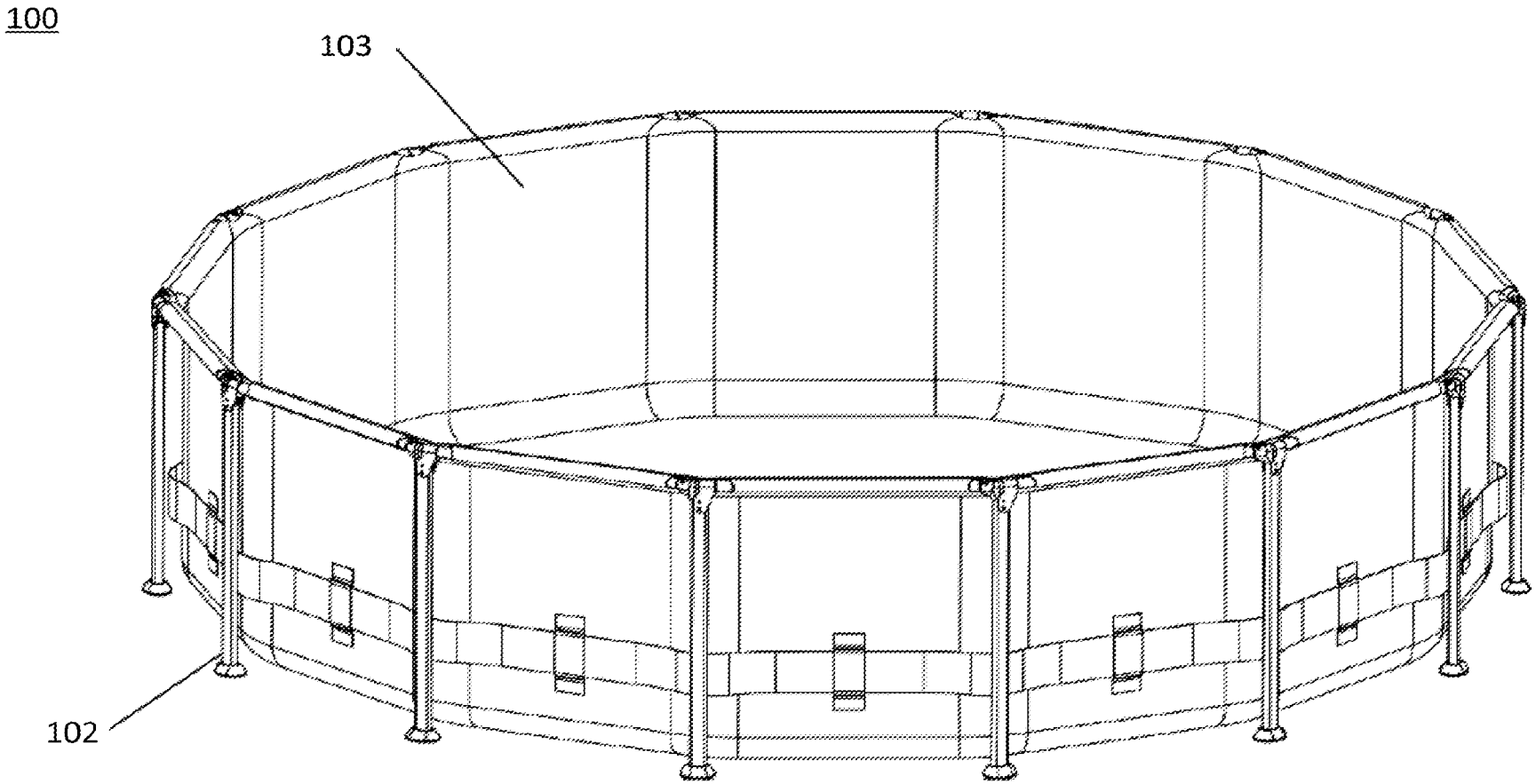
FIGS. 1A-1B illustrate exemplary embodiments of a pool.

FIG. 1A shows an exemplary embodiment of pool 100. In some embodiments, pool 100 may include a frame 102. Frame 102 may include a horizontal frame member and a vertical frame member. Pool 100 may include pool liner 103. Pool liner 103 may be configured to hold water within frame 102. Pool liner 103 may be configured to take up the volume within frame 102. Pool liner 104 may be configured to attach to the frame. Pool liner 103 may include a band configured to contain a bulging force created by water in the pool liner. The band may be a reinforcement of pool liner 104. The band may be connectable to frame 102. The band may be configured to be outside of the frame and attached to pool liner 104.

Pool liner 103 may be configured to attach to frame 102. In some embodiments, pool liner 103 may attach to one or more horizontal members, one or more vertical frame members, or a combination of at least one horizontal member and at least one vertical member. Other configurations of frame members and the orientation of frame members are known to those of skill in the art and contemplated herein. Such configurations may be used in addition to or in the alternative of vertical and horizontal frame members.

Figure 1B:
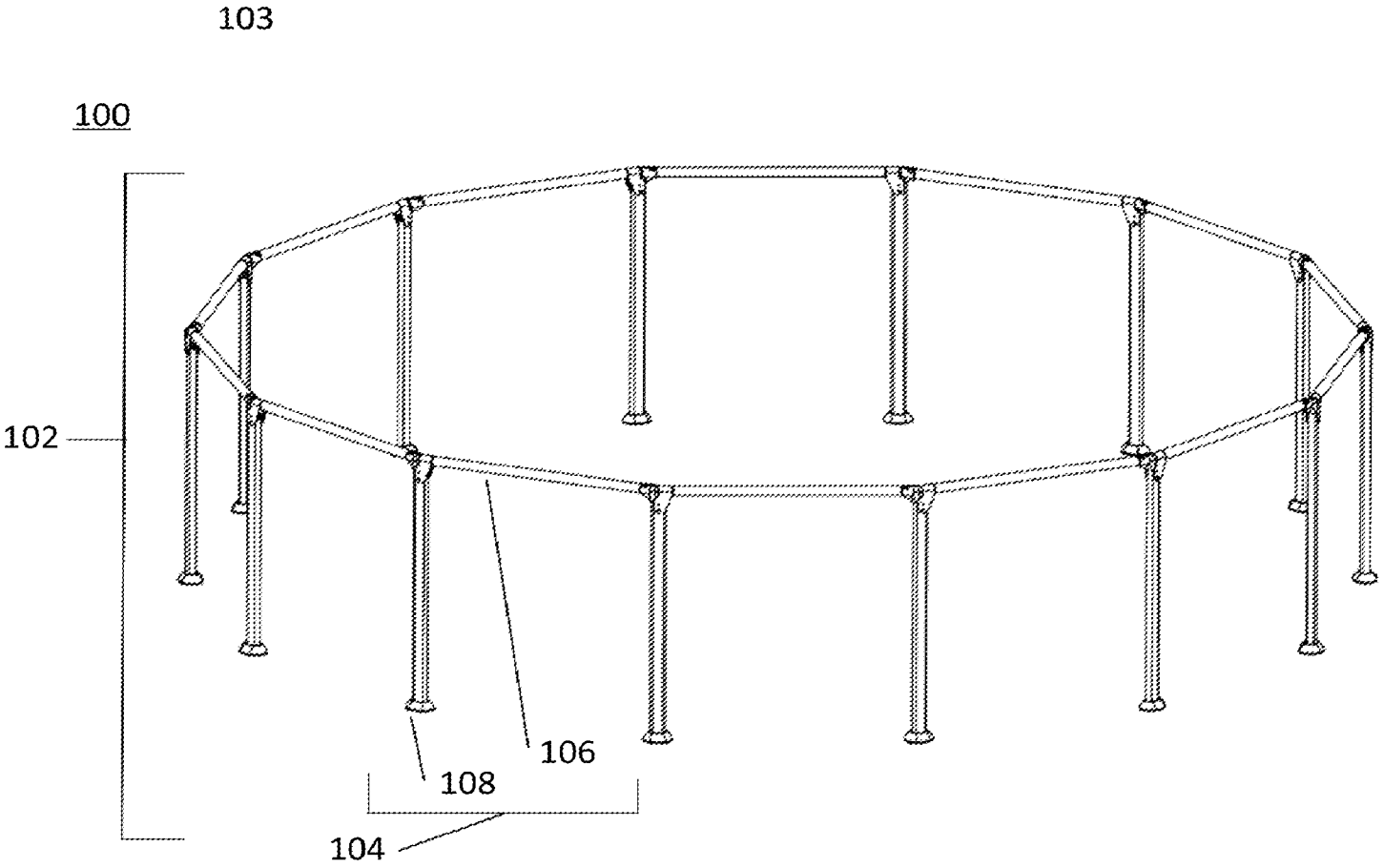

FIG. 1B shows an exemplary embodiment of a frame (e.g., frame 102). Frame 102 may be constructed before a pool liner (e.g., pool liner 103) is installed. In some embodiments, frame 102 may be constructed while installing the pool liner. Frame 102 may include frame link 104. Frame 102 may include a number of frame links to form a circumference of a desired pool area. The number of frame links may change to vary the circumference of the desired pool area.

Frame link 104 may include horizontal frame member 106 and vertical frame member 108. Vertical frame member 108 may stand substantially on top of a ground surface or a floor. As the weight of frame 102 and/or pool liner 103 containing water settles, the lower portions of vertical frame member 108 may move relative to other vertical frame members. In some embodiments, vertical frame member 108 may be connected to ground surface or floor via a pinned, threaded, press fit, or friction connection (e.g., buried in dirt and/or sand or encased in concrete).

Although vertical and horizontal frame members are described herein, a variety of frame members are contemplated that are not limited to strictly vertical or horizontal orientations. For example, frame members may be at an angle from vertical and connect to members at an angle from horizontal. It is contemplated that frame members may be triangular. It is contemplated that frame members may include diagonal supports. It is contemplated that frame members may be circular or elliptical.

Figure 2A:
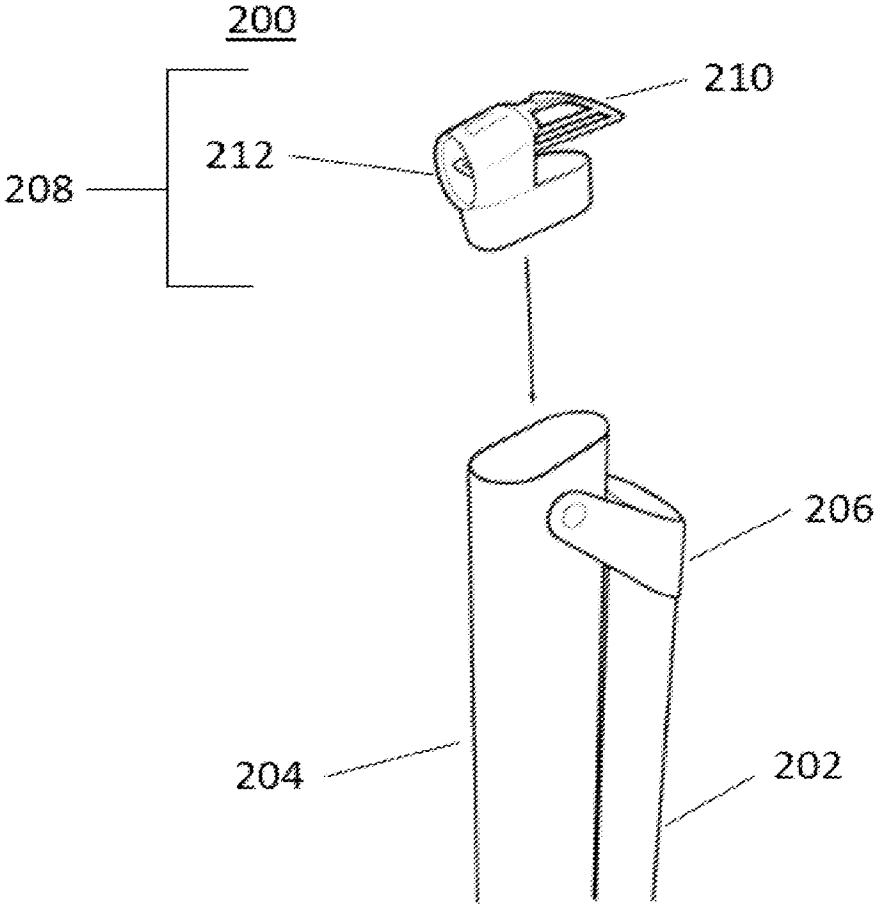
FIGS. 2A-2C illustrate exemplary embodiments of a pool frame assembly.
Figure 2B:
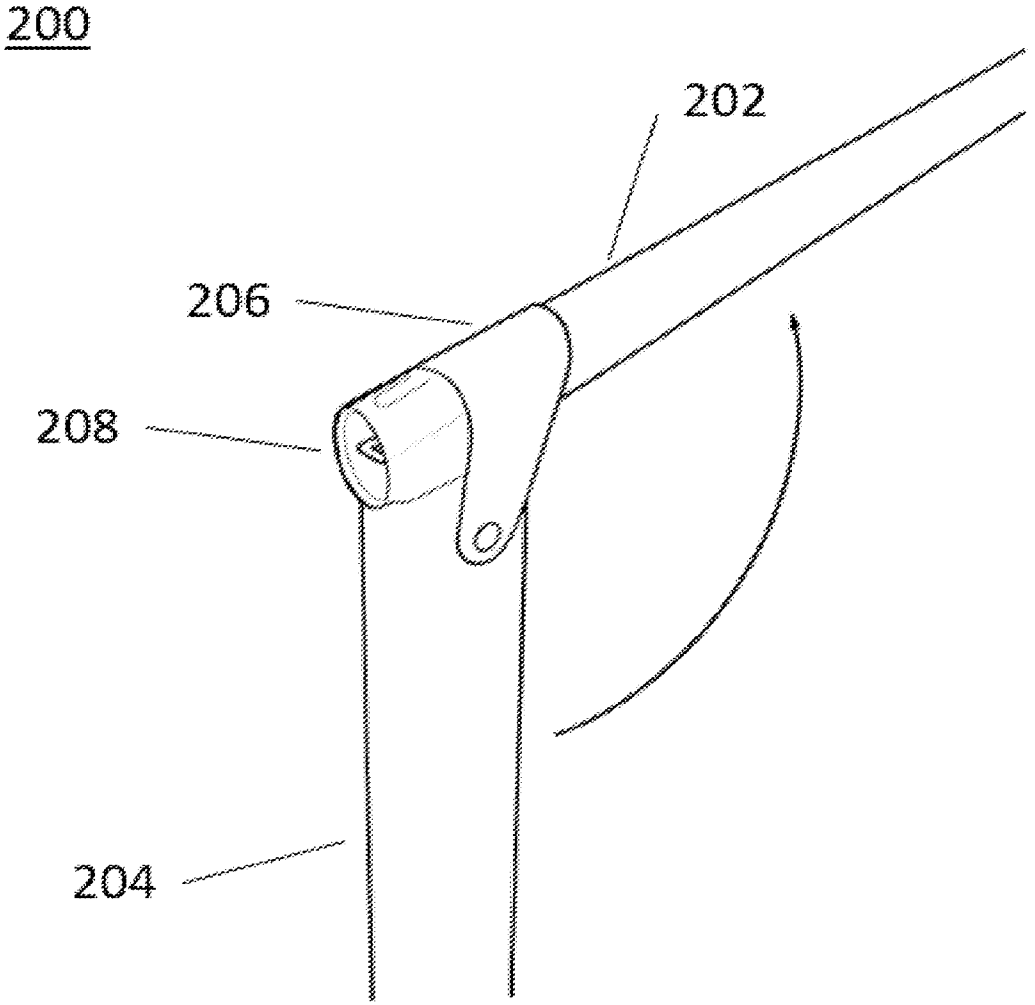
Figure 2C:
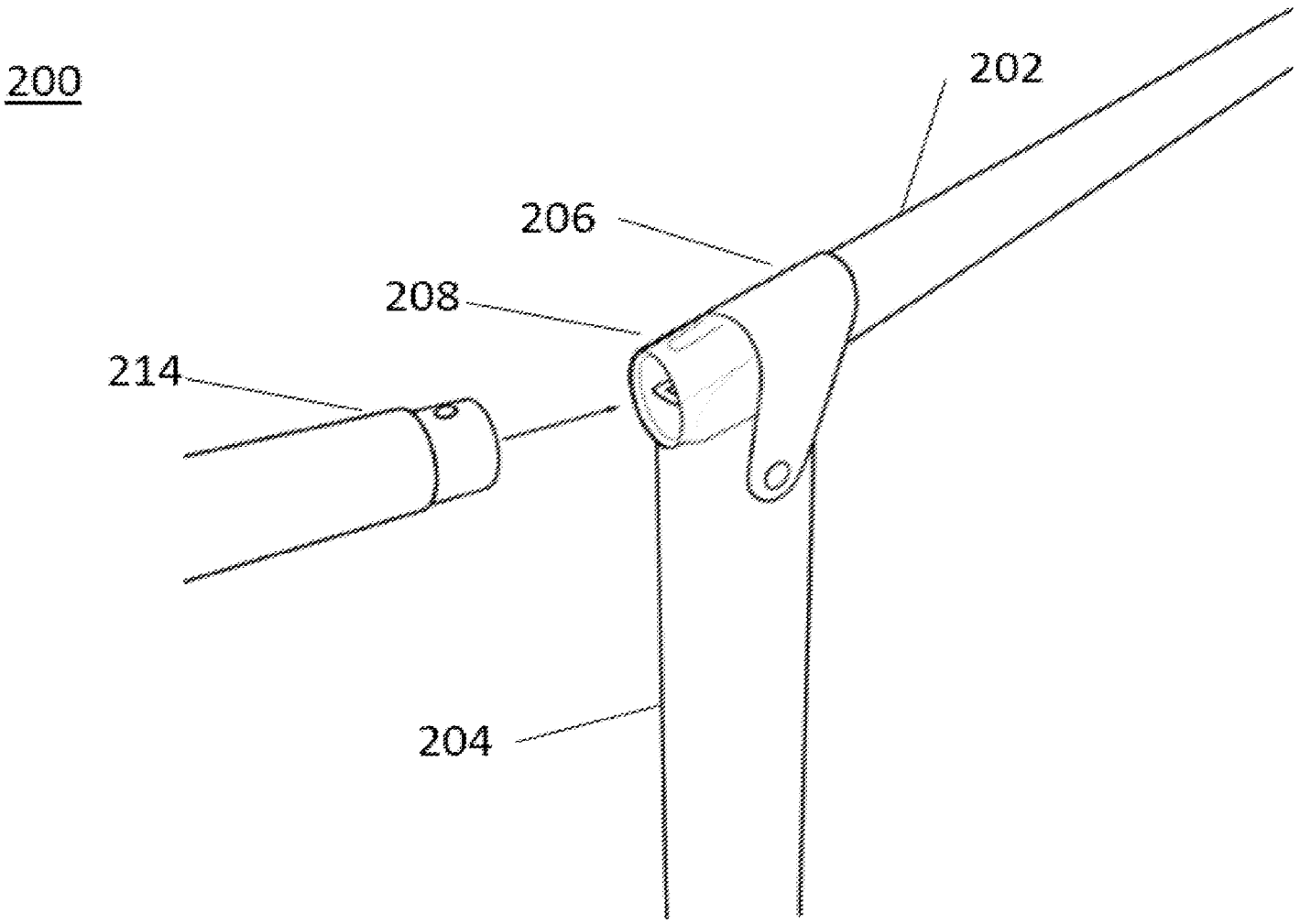

FIGS. 2A-2C illustrate exemplary embodiments of pool link 200. Certain features of pool link 200 are not shown or discussed in these examples where such features may be similar to those discussed for other embodiments.

FIG. 2A illustrates exemplary embodiments of a link of a pool frame. FIG. 2A show an exemplary embodiment of a portion of pool link 200. Pool link 200 may include a horizontal frame member 202 and a vertical frame member 204. Horizontal frame member 202 may be connected to vertical frame member 204 via pivoting attachment 206. Pivoting attachment 206 may be configured to attach to vertical frame member 204. In some embodiments, pivoting attachment 206 may attach to horizontal frame member 202. Pivoting attachment 206 may be connected to a frame member via one or more of an adhesive, threaded connection, welded connection, or another fixed connection. Pivoting attachment 206 may be connected to a frame member via one or more of a pinned connection, threaded connection, or a hinged connection.

Pool link 200 may include insert 208. Insert 208 may fit within a frame member. In some embodiments, insert 208 may connect to an outside surface of a frame member. Insert 208 may fit within a vertical portion of vertical frame member 204. In some embodiments, insert 208 may connect to and/or fit within a horizontal frame member. Insert 208 may be connected to a frame member via press fit, welded connected, or a pinned or threaded connection. In some embodiments, insert 208 may be a protrusion of a frame member.

Insert 208 may include first mating surface 210 and second mating surface 212. First mating surface 210 may connect to a first frame member such as horizontal frame member 202. First mating surface 210 may connect to the frame member via press fit, clip, adhesive, weld, or pinned or threaded connection. First mating surface 210 may fit within horizontal frame member 204 to provide a sufficient contact surface to hold a portion of the weight of water within a pool liner. Second mating surface 212 may fit over a second frame member, such as a horizontal frame member from another pool frame link. Second mating surface 212 may connect to the second frame member via press fit, clip, adhesive, weld, or pinned or threaded connection.

In some embodiments, horizontal frame member 202 may be guided via a string, elastic, or rigid member to locate and/or install horizontal frame member 202 to insert 208. First and second mating surfaces 210, 212 may include one or more clips to fit within one or more corresponding recession portions on the corresponding frame members. First and second mating surfaces 210, 212 may be flexible for ease of assembly.

FIG. 2B illustrates exemplary embodiments of a link of a pool frame. FIG. 2B shows an exemplary embodiment of a portion of pool link 200. Horizontal frame member 202 may rotate via pivoting attachment 206. Horizontal frame member 202 may be configured to be moved to pivot away from a stored position into a locked position. The locked position may be a position where horizontal frame member 202 is engaged with a mating surface of insert 208, such as second mating surface 212. Horizontal frame member 202 may be stored substantially along vertical frame member 204 such that the frame members may be easily transported and/or stored. Although a direction of movement of horizontal frame member 202 is shown relative to vertical frame member 204, it is contemplated that horizontal frame member 202 may move in a number of directions to engage with insert 208.

FIG. 2C illustrates exemplary embodiments of a link of a pool frame. FIG. 2C shows an exemplary embodiment of a portion of link 200. A mating horizontal frame member 214 of another link may be configured to connect to link 200. Mating horizontal frame member 214 may connect to insert 208. Mating horizontal frame member 214 may connect to a mating surface (e.g., second mating surface 212).

Figure 3B:
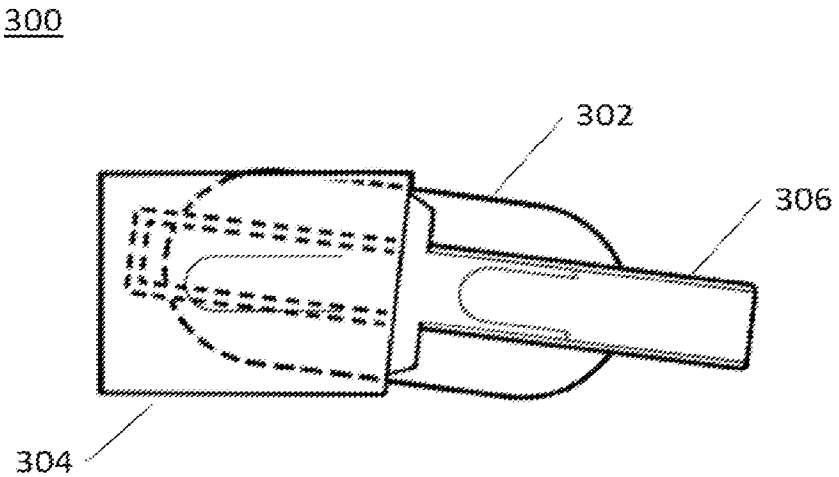
FIGS. 3A-3B illustrate an exemplary embodiment of a frame insert.
Figure 3A:
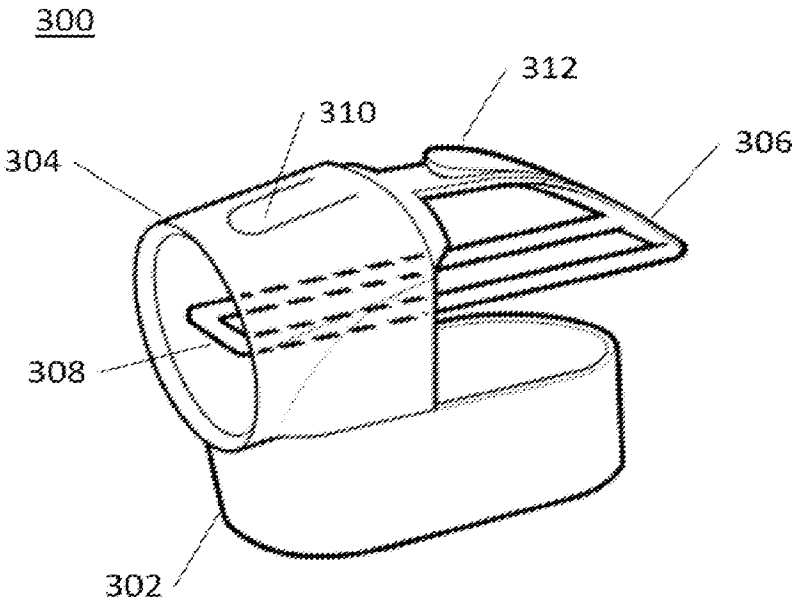

FIGS. 3A-3B illustrate exemplary embodiments of a pool link insert. Certain features of pool link insert 300 are not shown or discussed in these examples where such features may be similar to those discussed for other embodiments. Pool link insert 300 may be similar to pool link insert 208.

FIG. 3A shows an exemplary embodiment of a pool link insert. Insert 300 may include base 302, first mating portion 304, and second mating portion 306. First mating portion 304 may include first locking tab 310 that may fit into a corresponding recessed portion of a first mating frame member (e.g., horizontal frame member 214). First locking tab 310 may be configured to be pressed to release the first mating frame member from first mating portion 304. Second mating portion 306 may include a second locking tab 312. Second locking tab 312 may fit into a corresponding recessed portion of a second mating frame member (e.g., horizontal frame member 202). Second locking tab 312 may be configured to be pressed to release the second mating frame member from insert 300. Insert 300 may include elongated member 308. Elongated member 308 may be configured to be pushed to release the second mating frame member from second mating portion 306.

FIG. 3B shows an exemplary embodiment of a pool link insert. Insert 300 may include an angle between first mating portion 304 and second mating portion 306. The angle between first mating portion 305 and second mating portion 306 may be determined based on a number of inserts used in a number of links that form the circumference of a pool (e.g., pool 100). In some embodiments, the angle between first mating portion 305 and second mating portion 306 may be adjustable. Base 302 may be at an angle different from at least one of first mating portion 304 and second mating portion 306. Base 302 may be aligned to connect with a vertical frame member (e.g., vertical frame member 204). Base 302 may be inserted into the vertical frame member.

Figure 4:
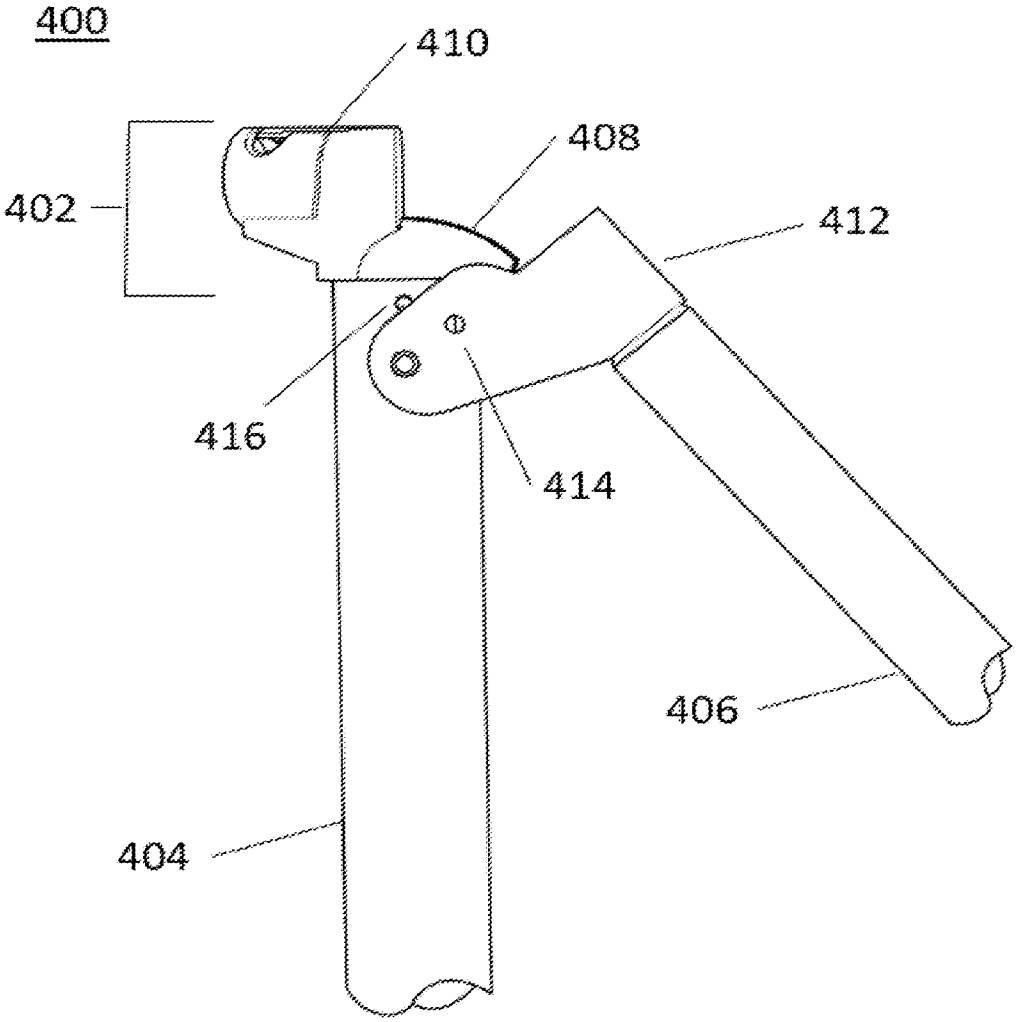
FIG. 4 illustrates an exemplary embodiment of a pool frame assembly.

FIG. 4 illustrates an exemplary embodiment of a portion of a pool frame link. Link 400 may include insert 402. Insert 402 may protrude from vertical frame member 404. In some embodiments, insert 402 may be connected to vertical frame member 404 via a press fit, adhesive, weld, or threaded or pinned connection. Insert 402 may include support 408 and mating portion 410. Horizontal frame member 406 may be connected to pivoting attachment 412. Pivoting attachment 412 may rotate about a pivot that may include a hinge or a pin. Pivoting attachment 412 may include pin 416 to lock pivoting attachment 412 in place relative to vertical frame member 404. Pin 416 may include a spring to bias pin 416 outward. Pin 416 may fit into hole 414 when pivoting attachment 412 is in a locked position. Pivoting attachment 412 may mate against insert 402 to form a structural joint. Pivoting attachment 412 may connect to insert 402 via being configured to be held against and/or connecting to support 408. Pivoting attachment 412 may slide over support 408. In some embodiments, a protruding portion of pivoting attachment 412 may fit within a recessed portion of support 408.

Consistent with disclosed embodiments, installing and/or constructing a pool may include steps and/or an order of steps. Although steps and the order of steps are contemplated, the steps may be combined, omitted, reordered, and/or integrated into other processes to perform the tasks contemplated herein.

Figure 5B:
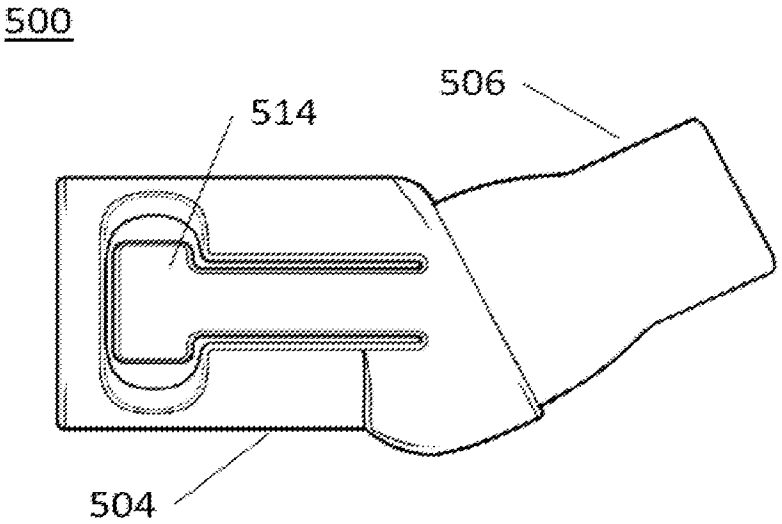
FIGS. 5A-5B illustrate an exemplary embodiment of a frame insert.
Figure 5A:
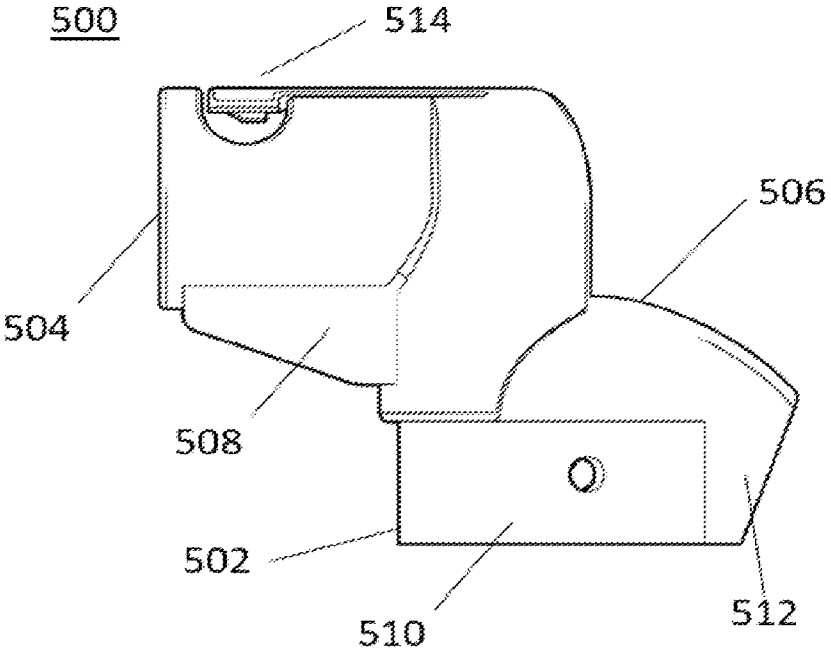

FIGS. 5A-5B illustrate exemplary embodiments of a pool link insert. Certain features of pool link insert 500 are not shown or discussed in these examples where such features may be similar to those discussed for other embodiments. Pool link insert 500 may be similar to pool link insert 402.

FIG. 5A shows an exemplary embodiment of a pool link insert. Insert 500 may include base 502, first mating portion 504, and second mating portion 506. First mating portion 504 may include first locking tab 514 that may fit into a corresponding recessed portion of a first mating frame member. First locking tab 514 may be configured to be pressed to release the first mating frame member from first mating portion 504. Insert 500 includes first protrusion 508 such that the first mating frame member may connect to the top portion of protrusion 508. Base 502 may include recess 510 for mating to a first frame member (e.g., vertical frame member 404). Recess 510 may include a hole for a locking tab to lock to the first frame member. Recess 510 may include a hole for a locking tab to lock to a second frame member (e.g., horizontal frame member 406). Recess 510 may include a locking member, such as a pin and/or a clip, for both the first frame member and second frame member. Second mating portion 506 may connect to a pivoting portion (e.g., pivoting portion 412) and/or the second frame member (e.g., horizontal frame member 406). Second mating portion 506 may include recessed portion 512 to connect to the second frame member.

FIG. 5B shows an exemplary embodiment of a pool link insert. Insert 500 may include an angle between first mating portion 504 and second mating portion 506. The angle between first mating portion 504 and second mating portion 506 may be determined based on a number of inserts used in a number of links that form the circumference of a pool (e.g., pool 100). In some embodiments, the angle between first mating portion 504 and second mating portion 506 may be adjustable. Base 502 may be at an angle different from at least one of first mating portion 504 and second mating portion 506. Base 502 may be aligned to connect with a first frame member (e.g., vertical frame member 404). Base 502 may be inserted into the first frame member.

Figure 6B:
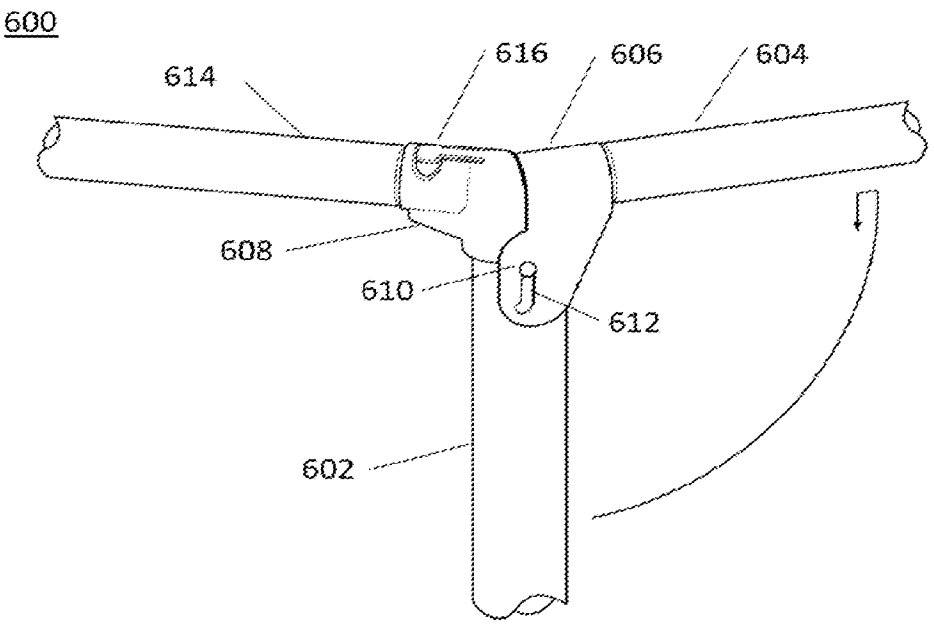
FIGS. 6A-6B illustrate exemplary embodiments of a pool frame assembly.
Figure 6A:
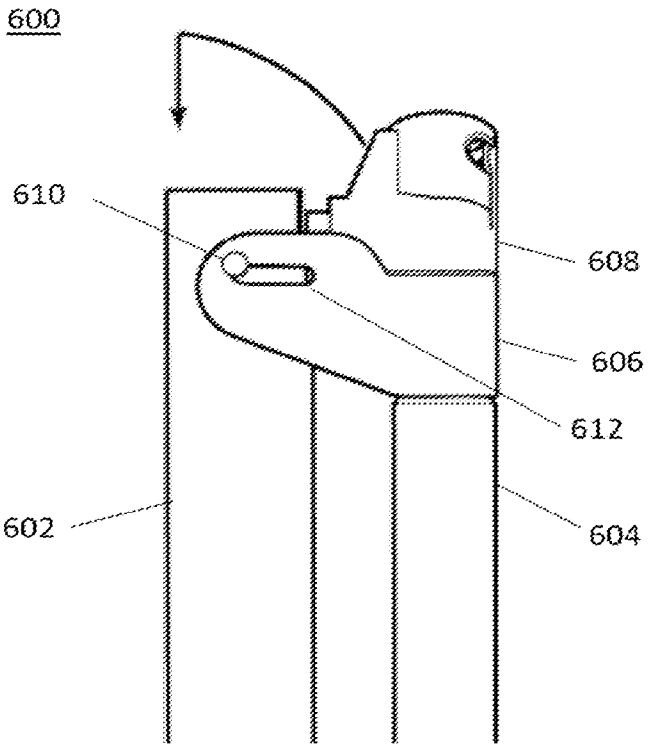

FIGS. 6A-6B illustrate an exemplary embodiment of a portion of a pool frame link. Link 600 may include vertical frame member 602, horizontal frame member 604, and insert 608. Insert 608 may connect to horizontal frame member 604 via a clip, a press fit, an adhesive, a pinned, and/or threaded connection. Horizontal frame member 604 may include pivoting attachment 612. Pivoting attachment 606 may be configured to connect to vertical frame member 602 via pin 610. Pin 610 may fit into slot 612. Pin 610 may slide along slot 612. When horizontal frame member 604 is in a resting position, pin 610 may be towards one end of slot 612. Insert 608, pivoting attachment 606, and horizontal frame member 604 may move such that insert 608 fits within vertical frame member 602. Insert 608 fitting within vertical frame member 602 may be a locked position. When horizontal frame member 604 is in the locked position, pin 610 may be towards one end of slot 612. Second horizontal frame member 614 may connect to insert 608. Second horizontal frame member 614 may slide into insert 608. Insert 608 may include locking tab 616 with one or more protrusions. One or more protrusions of locking tab 616 may mate to one or more recessed portions of second horizontal frame member 614 to lock second horizontal frame member 614.

Figure 7A:
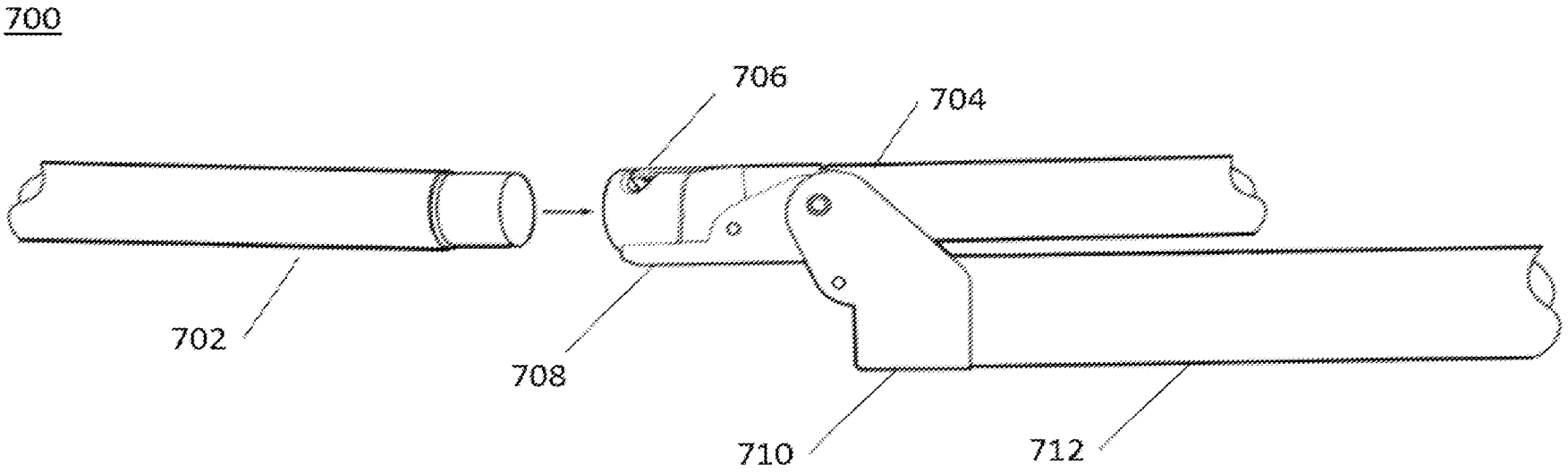
FIGS. 7A-7C illustrate exemplary embodiments of a pool frame assembly.
Figure 7C:
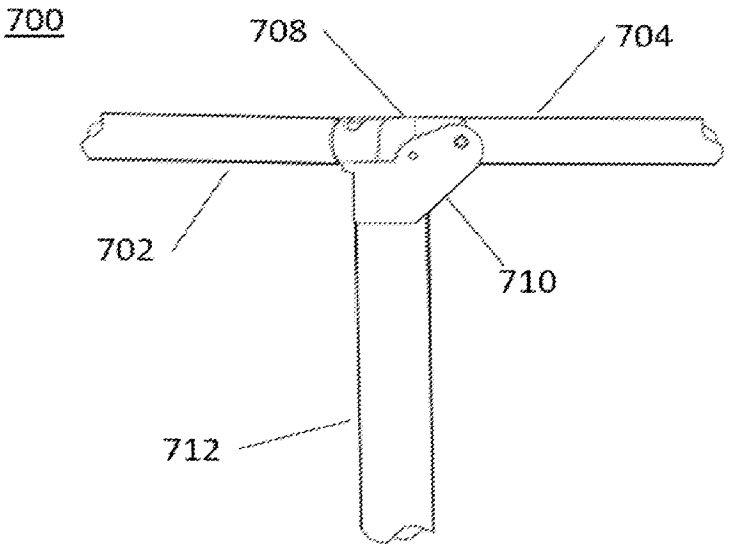
Figure 7B:
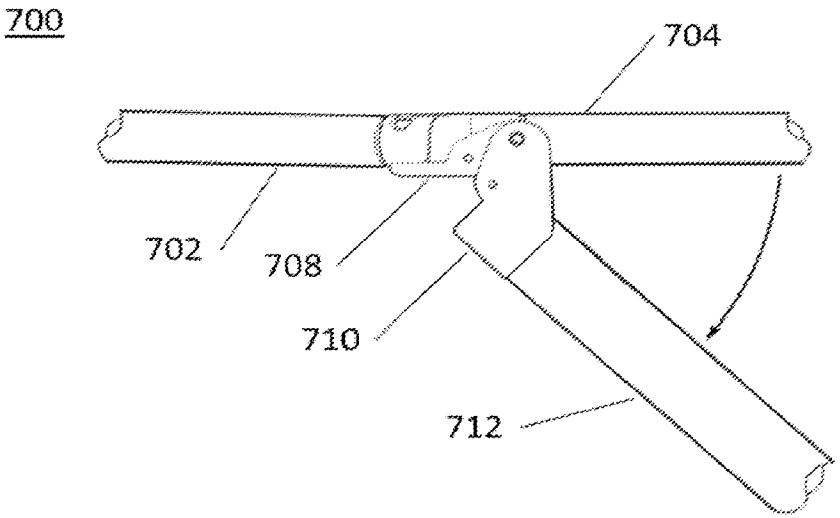

FIGS. 7A-7C illustrates an exemplary embodiment of a portion of a pool frame link. Link 700 may include first horizontal frame member 702, second horizontal frame member 704, and third vertical frame member 712. Second horizontal frame member 704 may include connecting portion 708. Connecting portion 708 may be attached to second horizontal frame member 704 via a clip, a press fit, an adhesive, a pinned, and/or a threaded connection. Connecting portion 708 may connect to first horizontal frame member 702 via a clip, a pinned, a threaded, and/or a press fit connection. Connecting portion 708 may include tab 706 that locks first horizontal frame member 702 when connected. Tab 706 may connect to a corresponding recessed portion on first horizontal frame member 702. Vertical frame member 712 may include pivoting attachment 710. Pivoting attachment 710 may pivot about a pin on second horizontal frame member 704 and/or connecting portion 708. Connecting portion 708 may connect to and/or abut against pivoting attachment 710 when vertical frame member 712 moves to a locked position. Connecting portion 708 may lock on top of pivoting attachment 710 such that the weight of frame members 702, 704 and/or a pool liner containing water attaching to frame member 702, 704 may be transmitted to vertical frame member 712. Pivoting attachment 710 may include a locking pin to lock vertical frame member 712. The locked position of vertical frame member 712 may be shown in FIG. 7C.

Figure 8B:
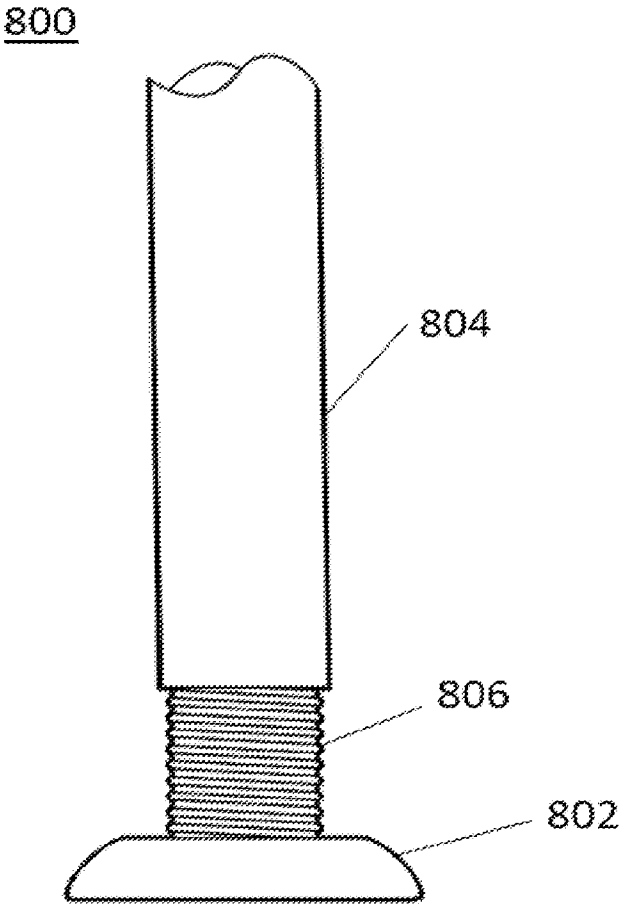
FIGS. 8A-8B illustrate exemplary embodiments of a portion of a pool frame link.
Figure 8A:
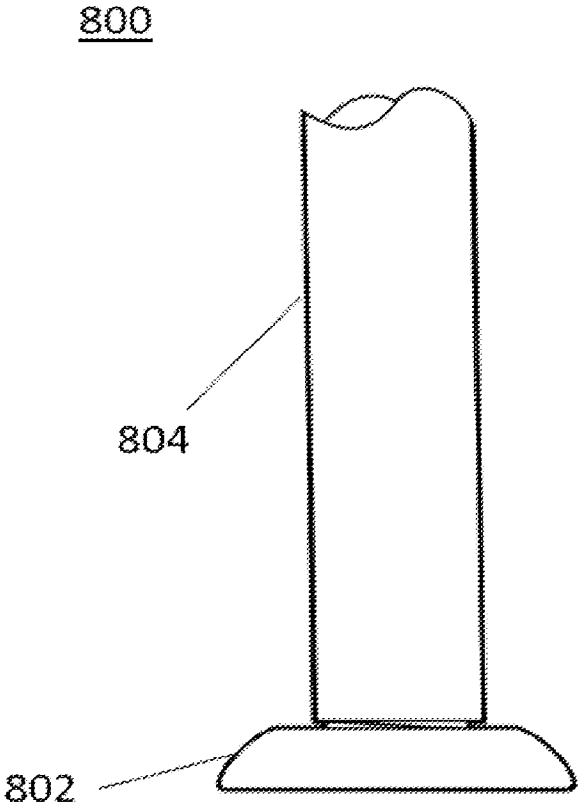

FIGS. 8A-8B illustrates an exemplary embodiment of a portion of a pool frame link. Link 800 may include foot 802 and vertical frame member 804. Link 800 may include a telescoping, a threading, and/or a pinned connection to adjust the height of vertical frame member 804. Link 800 may include threaded section 806 such that vertical frame member 804 may be moved towards or away from foot 802. Foot 802 may be designed to transmit the weight of vertical frame member 804 and a pool liner containing water to the ground or floor.

Figure 9:
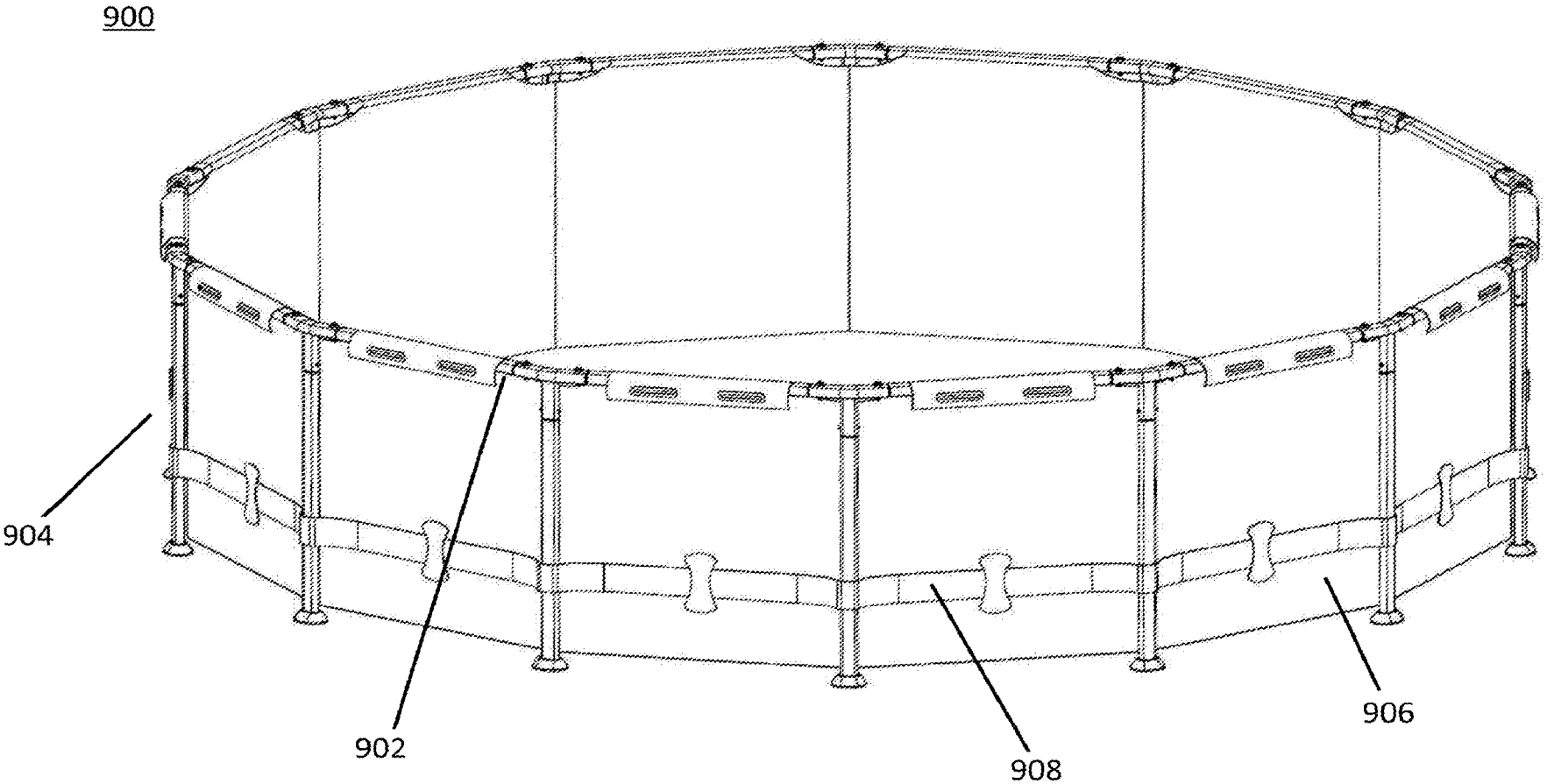
FIG. 9 illustrates an exemplary embodiment of a pool.

FIG. 9 shows an exemplary embodiment of pool 900. In some embodiments, pool 900 may comprise one or more horizontal frame members 902 and one or more vertical frame members 904. Pool 900 may comprise liner 906. Pool 900 may comprise band 908. Band 908 may be configured to attach to liner 906 and pass around the one or more vertical frame members 904. Liner 906 may be configured to hold water within a frame comprising one or more horizontal frame members 902 and one or more vertical frame members 904. Band 908 may be a reinforcement of liner 906. In some embodiments, the frame may be constructed before liner 906 is attached to liner 906. The frame may include features configured to provide connections with liner 906.

Liner 906 may extend over one or more horizontal frame members 902 and/or around one or more vertical frame members 904. Liner 906 may include flaps that attach to the frame. Liner 906 may attach to one or more horizontal members, one or more vertical frame members, or a combination of at least one horizontal member and at least one vertical member. In some embodiments, liner 906 and a flap may be configured to be connected to a member of the frame after a member of the frame is passed through band 908.

Although vertical and horizontal frame members are described herein, a variety of frame members are contemplated that are not limited to strictly vertical or horizontal orientations. For example, frame members may be at an angle from vertical and connect to members at an angle from horizontal. It is contemplated that frame members may be triangular. It is contemplated that frame members may include diagonal supports. It is contemplated that frame members may be circular or elliptical.

FIGS. 10A-10M illustrate exemplary embodiments of pool liner connections. Certain features of a pool, vertical frame members, and horizontal frame members are not shown or discussed in these examples where such features may be similar to those discussed for other embodiments. The pool may be similar to the pool discussed above with reference to FIG. 9.

Figure 10A:
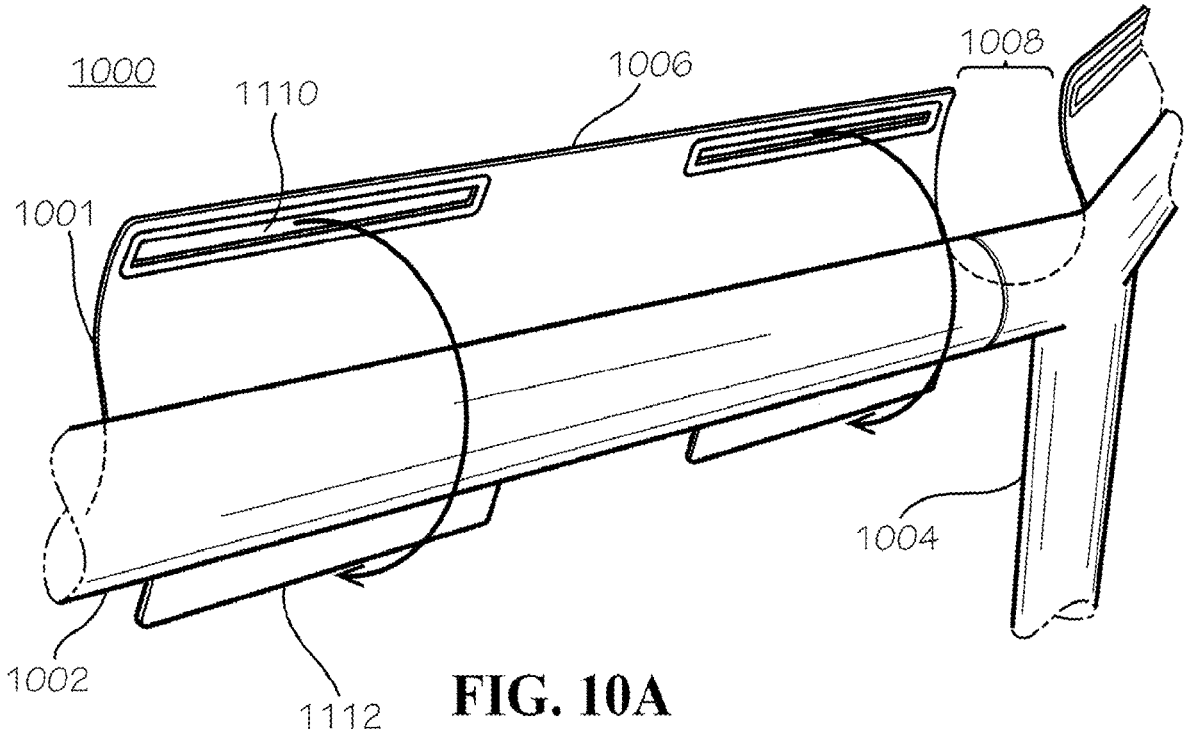
FIGS. 10A-10M illustrate exemplary embodiments of pool liner connections.
Figure 10B:
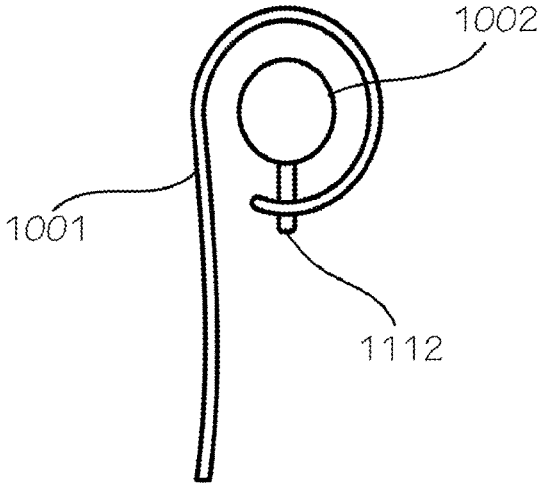

FIGS. 10A-10B show an exemplary embodiment of a portion of pool 1000. Pool 1000 may include horizontal frame member 1002, vertical frame member 1004, and pool liner 1006. Pool liner 1006 may be configured to be connectable to horizontal frame member 1002. Pool liner 1006 may include flap 1001. Flap 1001 may extend above horizontal frame member 1002. Flap 1001 may wrap around horizontal frame member 1002. Flap 1001 may be connectable to horizontal frame member 1002. Flap 1001 may include orifice 1110 configured to attach flap 1001 to horizontal frame member 1002. Horizontal frame member 1002 may include protrusion 1112. Protrusion 1112 may comprise an elongated, raised surface. In some embodiments, protrusion 1112 may be rectangular. Protrusion 1112 may be at least one of an extruded surface of horizontal frame member 10002 or a portion configured to be attached to horizontal frame member 1002 via a connection that includes a pin, a screw, a weld, or a press fit. Orifice 1110 may be configured to attach to protrusion 1112. In some embodiments, flap 1001 may include a reinforced portion surrounding orifice 1110. In some embodiments, pool liner 1006 may include a plurality of flaps that attach to a plurality of horizontal frame members to hold water within pool liner 1006 against the weight of the water. A weight of water may increase tension on flap 1001 to hold orifice 1110 onto horizontal frame member 1002. Pool liner 1006 may comprise a slot 1008 that separates one flap from another flap.

Figure 10C:
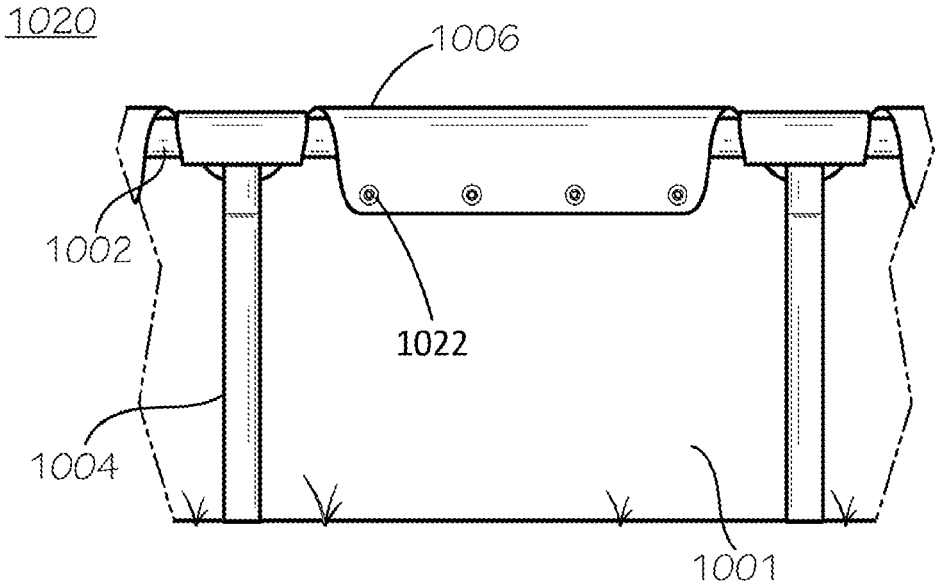
Figure 10D:
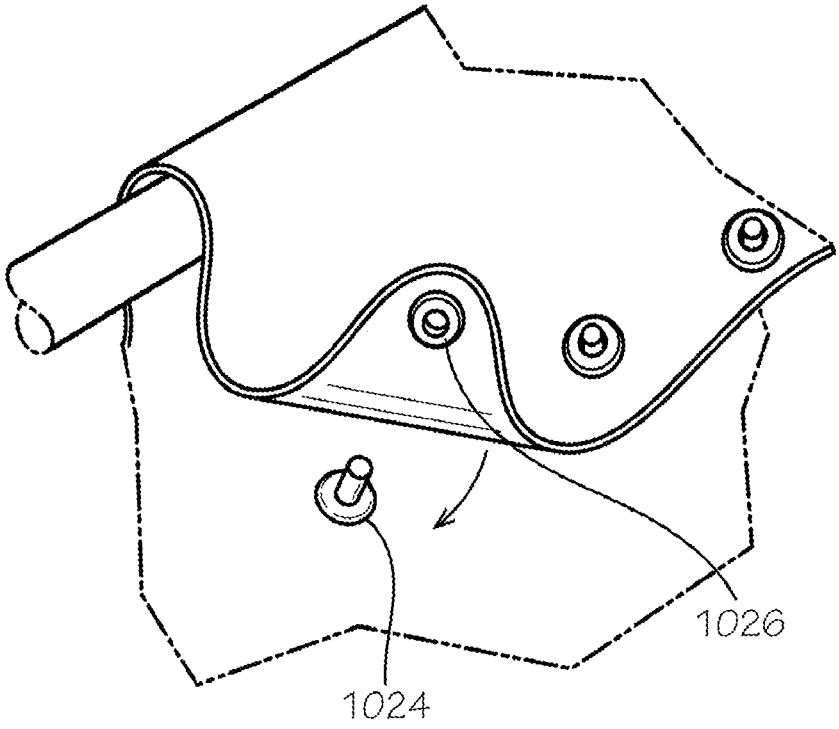

FIGS. 10C-10D show an exemplary embodiment of a portion of pool 1000. Pool 1000 may comprise pool liner connection 1020. Pool liner connection 1020 may comprise snaps 1022. Flap 1006 may comprise snaps 1022. Snaps 1022 may comprise first mating snap 1024 and second mating snap 1026. First mating snap 1024 may be configured to attach flap 1006 to pool liner 1001 where second mating snap 1026 is located. Flap 1006 may pass above and around horizontal frame member 1002 so that first mating snap 1024 may connect to second mating snap 1026.

Figure 10E:
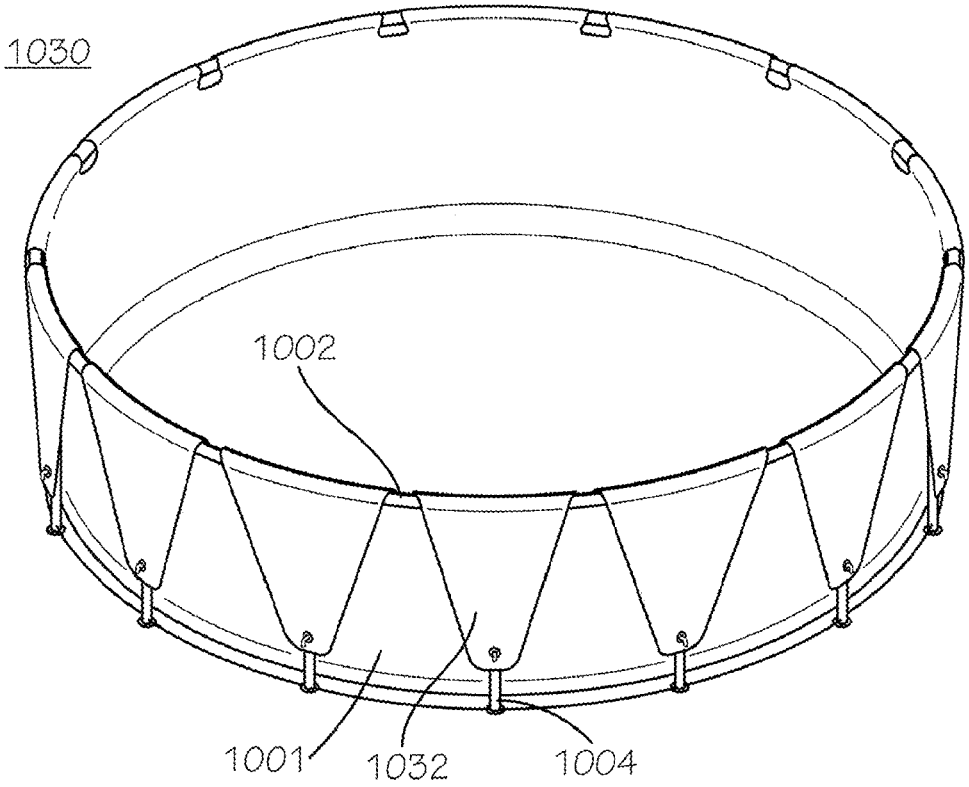
Figure 10F:
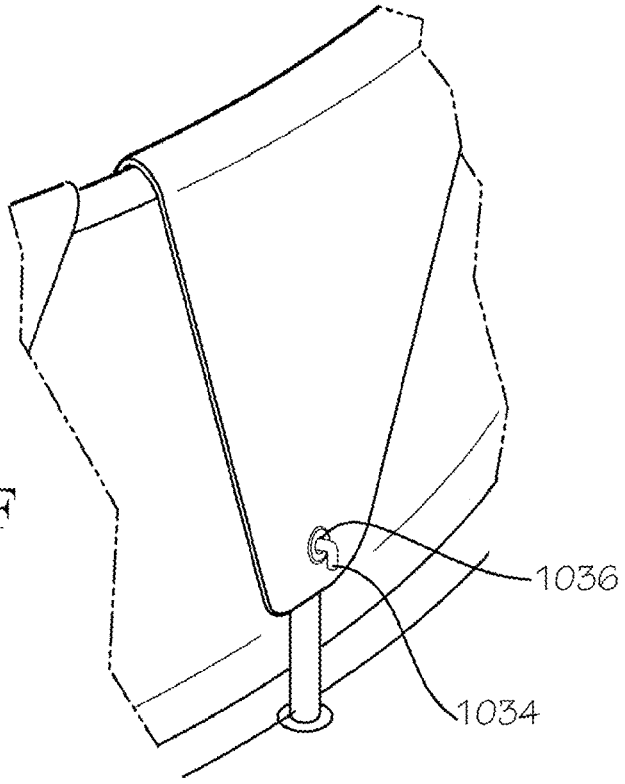

FIGS. 10E-10F show an exemplary embodiment of a portion of pool 1000. Pool 1000 may comprise pool liner connection 1030. Pool liner connection 1030 may comprise flap 1032. Flap 1032 may be configured to connect to one or more vertical frame members. Flap 1032 may comprise orifice 1036. Vertical frame member 1004 may comprise hook 1034. Hook 1034 may be attachable to vertical frame member 1004. Flap 1032 may be secured by orifice 1036 being connected to hook 1034. In some embodiments, flap 1032 may comprise a hook and vertical frame member 1004 may comprise an orifice. A weight of water may increase tension on flap 1032 to hold orifice 1036 against hook 1034.

Figure 10G:
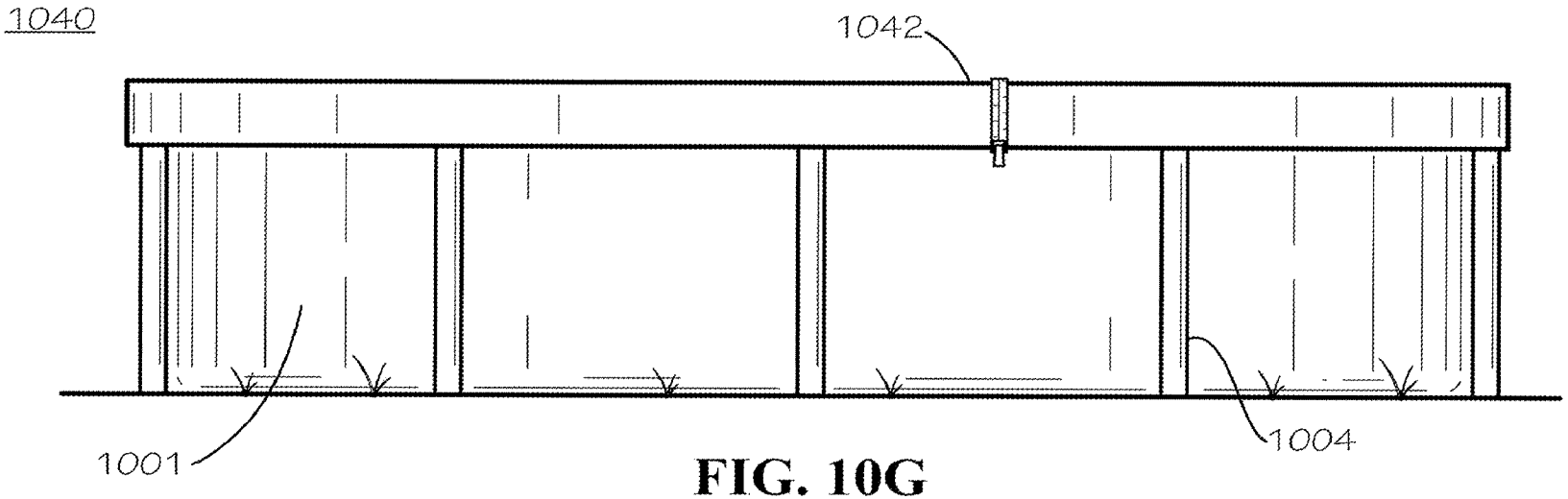
Figure 10H:
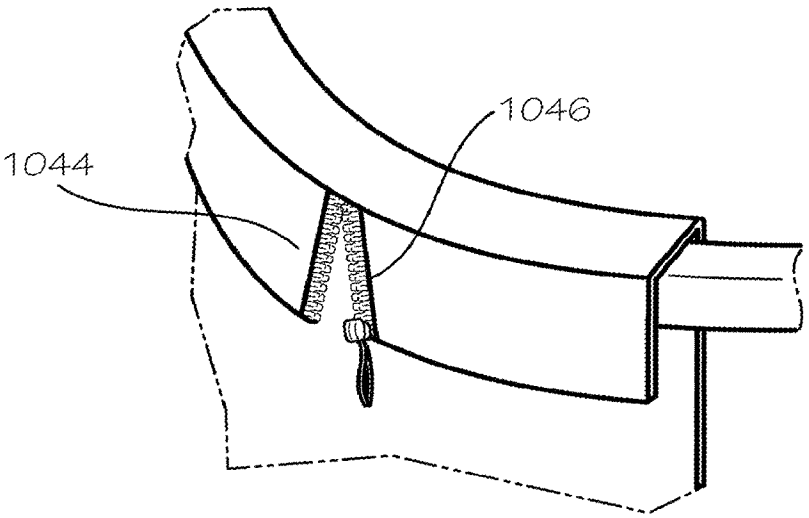

FIGS. 10G-10H show an exemplary embodiment of a portion of pool 1040. Pool 1040 may be similar to other pools disclosed herein. Pool liner 1001 may comprise flap 1042. Flap 1042 may extend above a horizontal frame member. Flap 1042 may wrap around the horizontal frame member. Flap 1042 may include first flap portion 1044 and second flap portion 1046. First flap portion 1044 may be connectable to second flap portion 1046 via a clasp lock and a clasp locker. In some embodiments, the connection between first flap portion 1044 and second flap portion 1046 may include a hook and loop connection. In some embodiments, the connection may include a strap buckle connection. In some embodiments, one or more clasp or hook and loop connections may be attached to vertical frame member 1004 or a horizontal frame member for attachment to flap 1042.

Figure 10I:
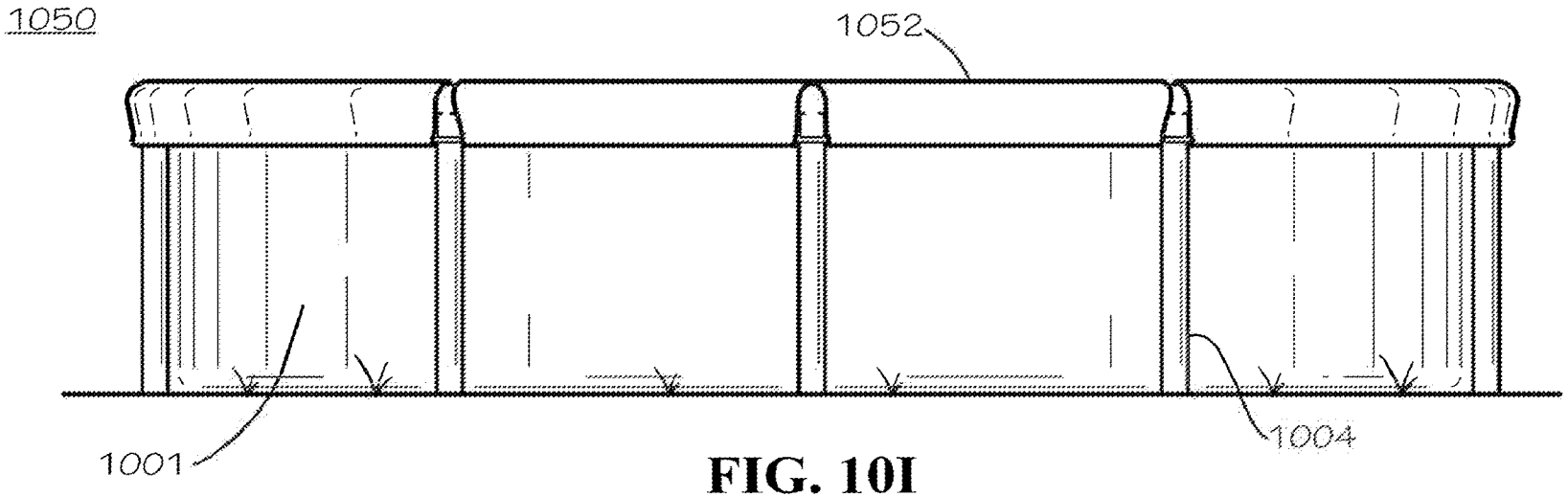
Figure 10J:
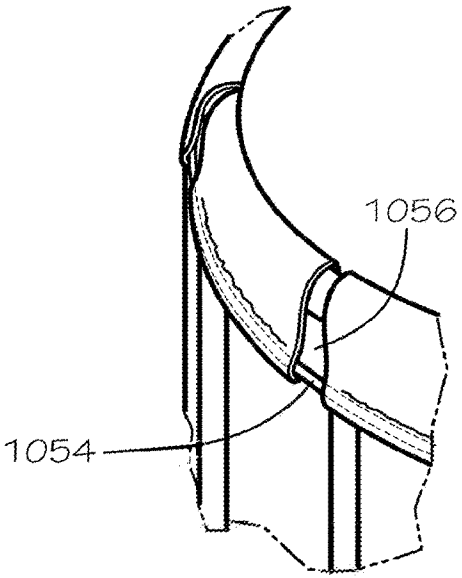

FIGS. 10I-10J show an exemplary embodiment of a portion of pool 1050. Pool 1050 may comprise flap 1052. Flap 1052 may comprise a liner gap configured to allow flap 1052 to expand as it passed over and around one or more horizontal members. Flap 1052 may comprise elastic band 1054. Elastic 1054 may be configured to hold pool liner 1001 against a frame of the pool. Flap 1052 may comprise elastic 1054 to hold flap 1052 below one or more horizontal frame members after it wraps around the one or more horizontal frame members. Elastic 1054 may extend from flap 1052 to one or more other flaps until it wraps around pool 1050 to hold one or more flaps.

Figure 10L:
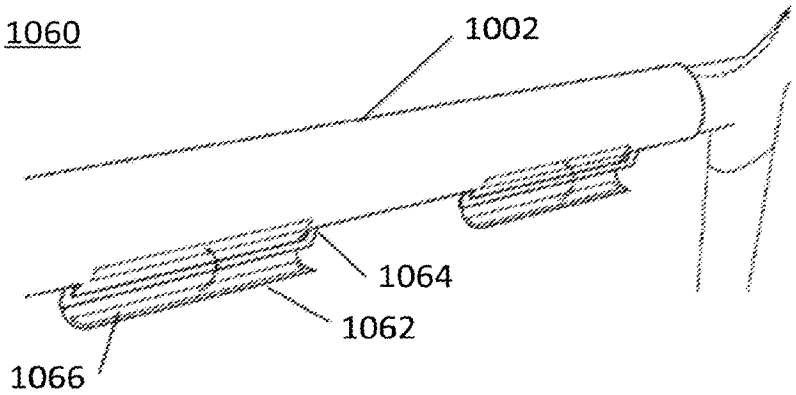
Figure 10K:
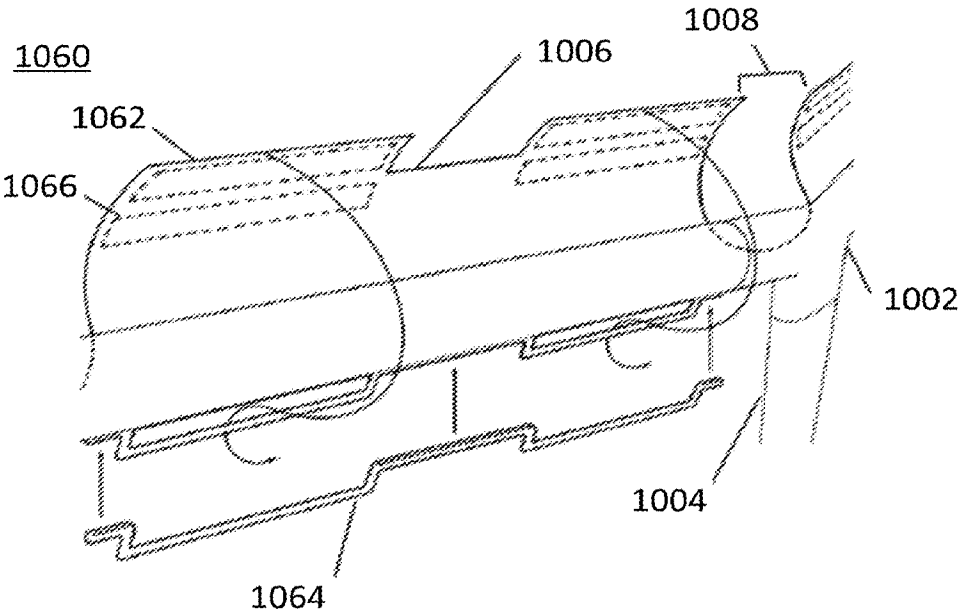

FIGS. 10K-10L show an exemplary embodiment of a portion of pool 1000. Pool 1000 may comprise pool liner connection 1060. Pool liner connection 1060 may comprise first connector 1062 and second connector 1066. Pool liner connection 1060 may comprise hangar 1064. First connector 1062 may be configured to pass through an aperture of hangar 1064. First connector 1062 may be configured to attach to second connector 1066 after passing through the aperture of hangar 1064. Hangar 1064 may comprise at least one of an extruded surface of horizontal frame member 1002. Hangar 1064 may comprise a portion configured to be attached to horizontal frame member 1002 via a connection that includes a pin, a screw, a weld, or a press fit. First connector 1062 may connect to second connector 1066 via at least one of hook and loop, adhesive, pin, or another connection type contemplated herein. Flap 1006 may include one or more sets of connectors and hangar 1064 may include a corresponding number of apertures.

Figure 10M:
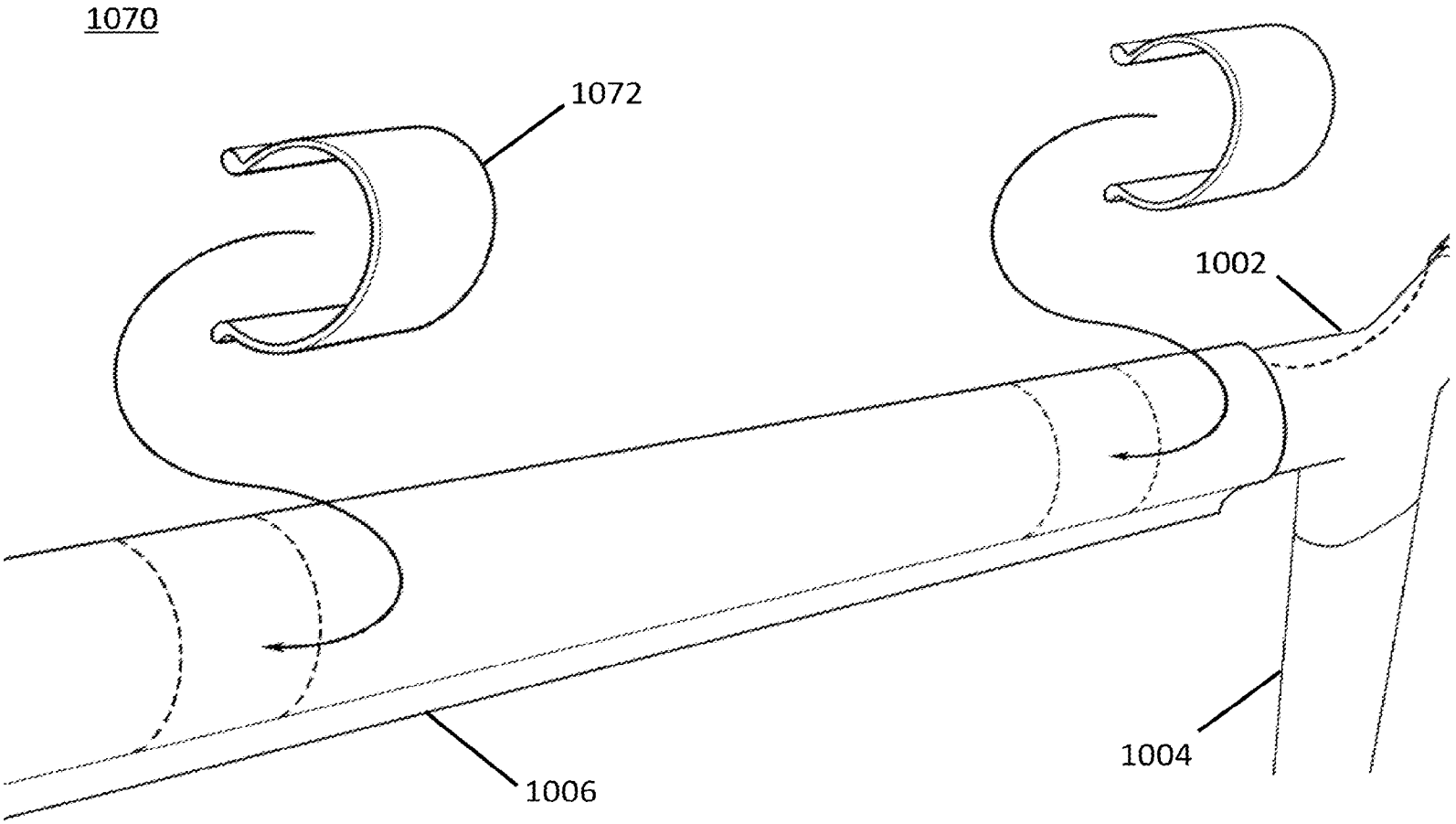

FIG. 10M shows an exemplary embodiment of a pool liner connection 1070. Pool liner connection 1070 may include clamp 1072. Flap 1006 may extend above horizontal frame member 1002. Flap 1006 may wrap around horizontal frame member 1002. Clamp 1072 may be used to attach flap 1006 to horizontal frame member 1002 and/or vertical frame member 1004. Clamp 1072 may be attachable to horizontal frame member 1002 via press fit, pin, or another connection type contemplated herein.

Figure 11A:
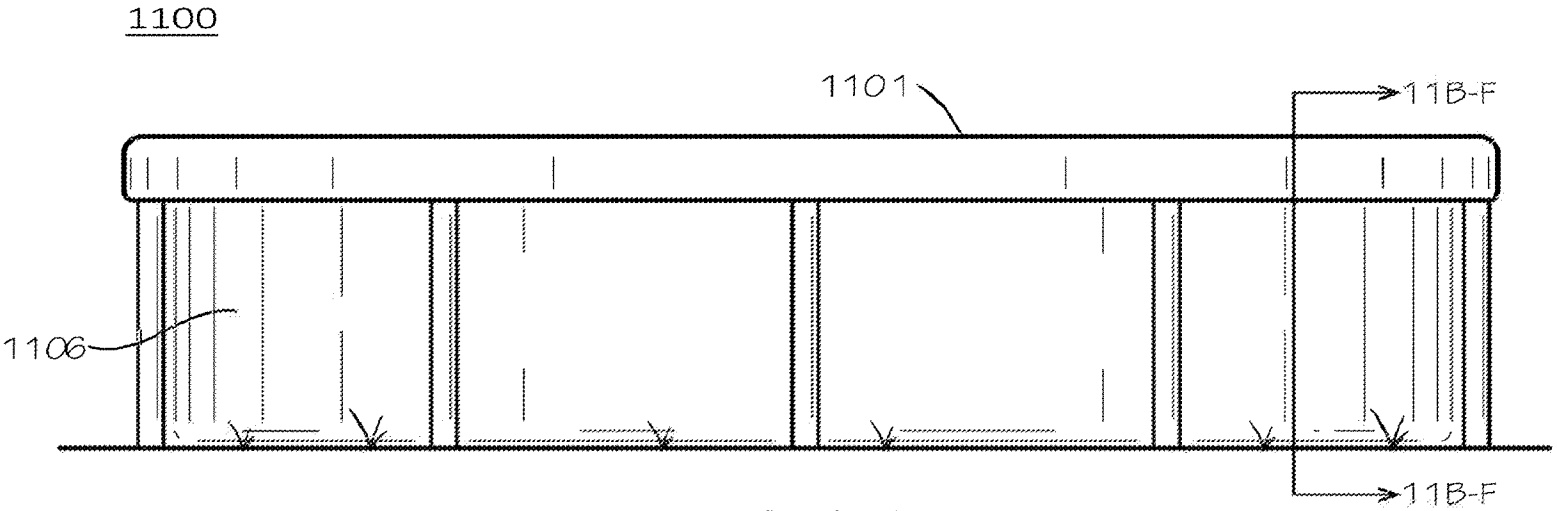
FIGS. 11A-11F illustrate exemplary embodiments of pool liner connections.

FIG. 11A illustrates an exemplary embodiment of a pool liner connection. FIGS. 11B-11F illustrate exemplary embodiments of a cross section of a pool liner connection. Certain features of pool 1100 are not shown or discussed in these examples where such features may be similar to those discussed for other embodiments.

FIG. 11A shows an exemplary embodiment of pool 1100. Pool 1100 may comprise pool liner 1101 and flap 1106. In some embodiments, flap 1101 may include one or more gaps according to some embodiments disclosed herein. Pool 1100 may comprise a horizontal frame member 1102 consistent with horizontal frame members disclosed herein.

Figure 11B:
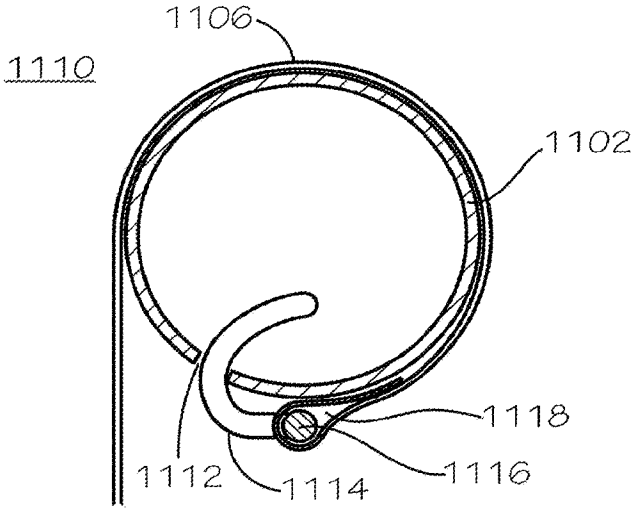
Figure 12:
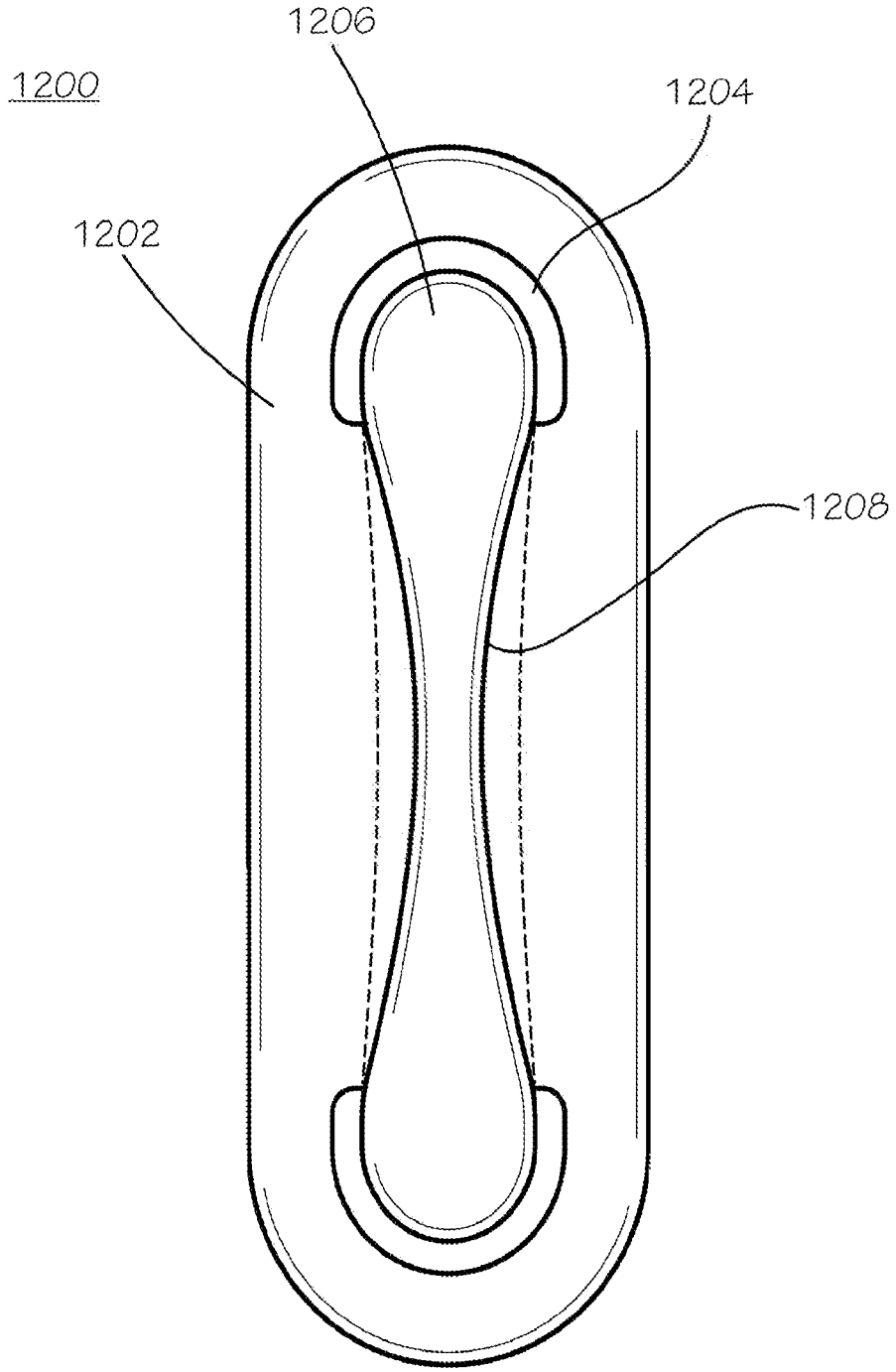
FIG. 12 illustrates an exemplary embodiment of a pool liner connection.

FIG. 11B shows an exemplary embodiment of a cross section of a pool liner connection 1110. Pool liner connection 1110 may comprise hook 1114, loop 1118, and dowel 1116. Horizontal frame member 1102 may comprise aperture 1112. Flap 1106 may connect to itself to attach flap 1106 to hook 1114 and dowel 1116. Dowel 1116 may be attached to hook 1114. Flap 1106 may connect to itself to form loop 1118 such as via a weld, adhesive, or other connection disclosed herein. Flap 1106 may extend above horizontal frame member 1102. Flap 1106 may wrap around horizontal frame member 1102. Hook 1114 may be configured to attach to aperture 1112 of horizontal frame member 1102.

Figure 11C:
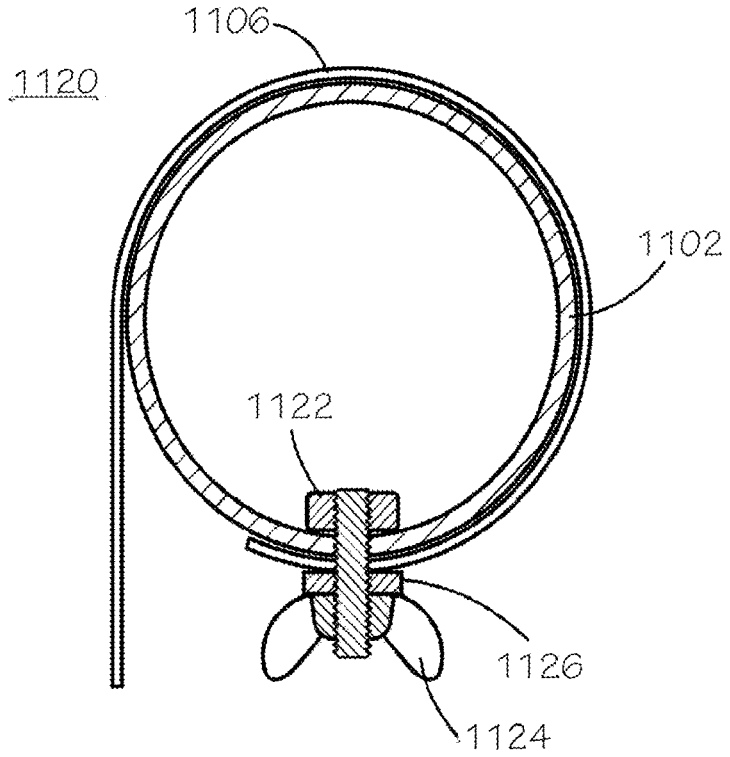

FIG. 11C shows an exemplary embodiment of a cross section of a pool liner connection 1120. Pool liner connection 1120 may comprise bolt 1122, nut 1124, and washer 1126. Bolt 1122 may be fixedly attached to horizontal frame member 1102. In some embodiments, bolt 1122 may be removably attached to horizontal frame member 1102 wherein one or more access holes allows for attachment of bolt 1122 to horizontal frame member 1102. Flap 1106 may comprise washer 1126. Flap 1106 may comprise a hole located at the center of washer 1126. Flap 1106 may be connected to bolt 1122 via press fit, pin, threaded, adhesive, weld, or another connection type contemplated herein. In some embodiments, bolt 1122 may comprise a threaded portion.

Figure 11D:
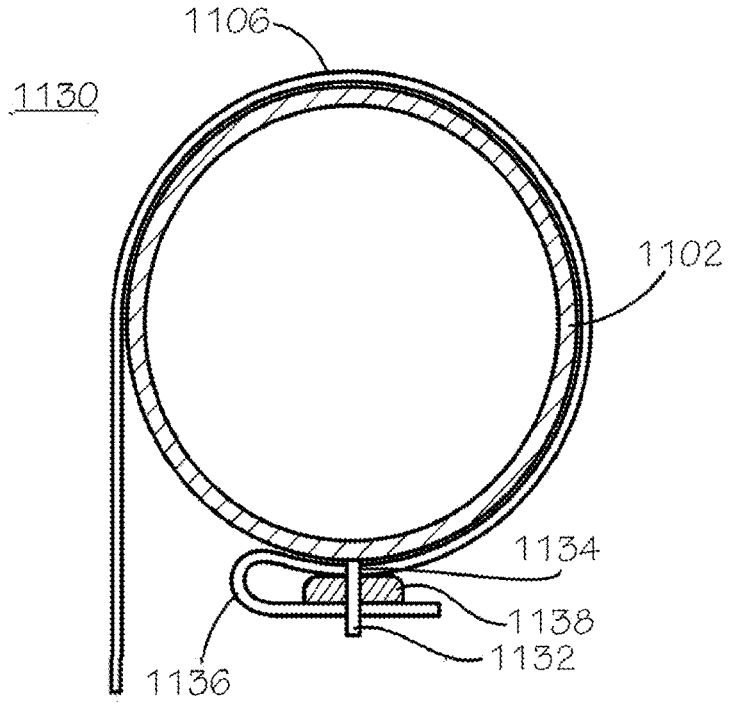

FIG. 11D shows an exemplary embodiment of a cross section of a pool liner connection 1130. Pool liner connection 1130 may comprise loop 1136, protrusion 1132, and orifice 1134. In some embodiments, pool liner connection 1130 may comprise connector 1138. Flap 1106 may fit onto and/or around protrusion portion 1132. Flap 1106 may be connected to protrusion portion 1132 via press fit, pin, threaded, adhesive, weld, or another connection type contemplated herein. Flap 1106 may form loop 1136 and include one or more apertures configured to mate to protrusion portion 1132. Flap 1106 may comprise connector 1138 that is configured to connect to protrusion portion 1132 via press fit, pin, threaded, weld, or another connection type contemplated herein. In some embodiments, flap 1106 may be welded to connector 1138.

Figure 11E:
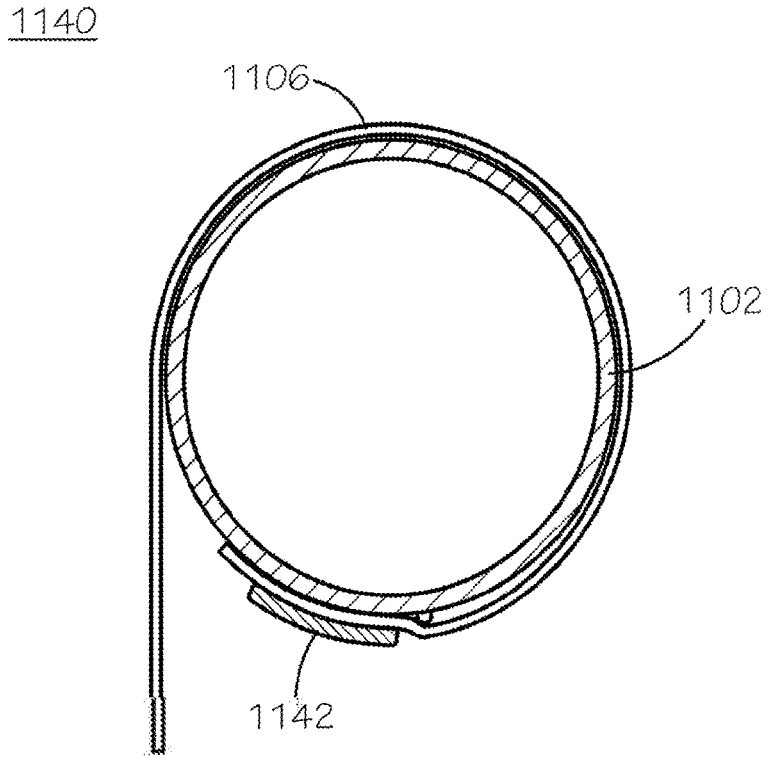

FIG. 11E shows an exemplary embodiment of a cross section of a pool liner connection 1140. Pool connection assembly 1140 may comprise magnetic plate 1142. Magnetic plate 1142 may be configured to magnetically hold flap 1106 against horizontal frame member 1102. Magnetic plate 1142 may be configured to hold flap 1106 below horizontal frame member 1102 after it wraps around horizontal frame member 1102. Magnetic plate 1142 may be flexible so that it matches the shape of horizontal frame member 1102. Horizontal frame member 1102 may be metallic. Horizontal frame member 1102 may have at least one of a metallic and a magnetic plate on an inside and/or outside surface of horizontal frame member 1102 to form a magnetic connection with magnetic plate 1142.

Figure 11F:
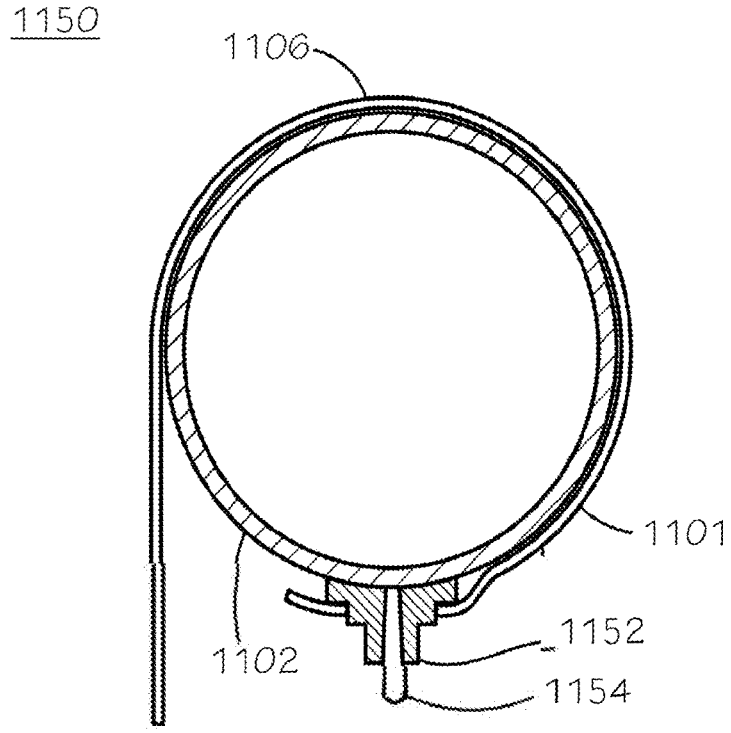

FIG. 11F shows an exemplary embodiment of a cross section of a pool liner connection 1150. Pool connection assembly 1150 may comprise protrusion 1154 and grommet 1152. Pool liner 1101 may comprise a welded connection to grommet 1152. Horizontal frame member 1102 may comprise protrusion portion 1154. In some embodiments, protrusion portion 1154 may be attachable to horizontal frame member 1102. Grommet 1152 may be configured to attach to protrusion portion 1154. Grommet 1152 may include one or more connection features such as a pin, a threaded connection, an adhesive, or another type of connection disclosed herein.

FIG. 12 shows an exemplary embodiment of pool liner connector 1200. Pool liner connector 1200 may be similar to grommet 1152 discussed above with reference to FIG. 11F. Pool liner connector 1200 may comprise body 1202, edge 1204, end aperture 1206, and narrowed aperture 1208. End aperture 1206 may be wider than narrowed aperture 1208. Narrow aperture 1208 may be attachable to a protrusion portion, such as protrusion portion 1154 discussed above with reference to FIG. 11F. End aperture 1206 may comprise a reinforced edge in a shape such as edge 1204. Body 1202 may be configured to attach to a liner. For example, body 1202 may be welded to a liner.

FIGS. 13A-13D illustrate exemplary embodiments of pool 1300. Certain features of pool 1300 are not shown or discussed in these examples where such features may be similar to those discussed for other embodiments.

Figure 13A:
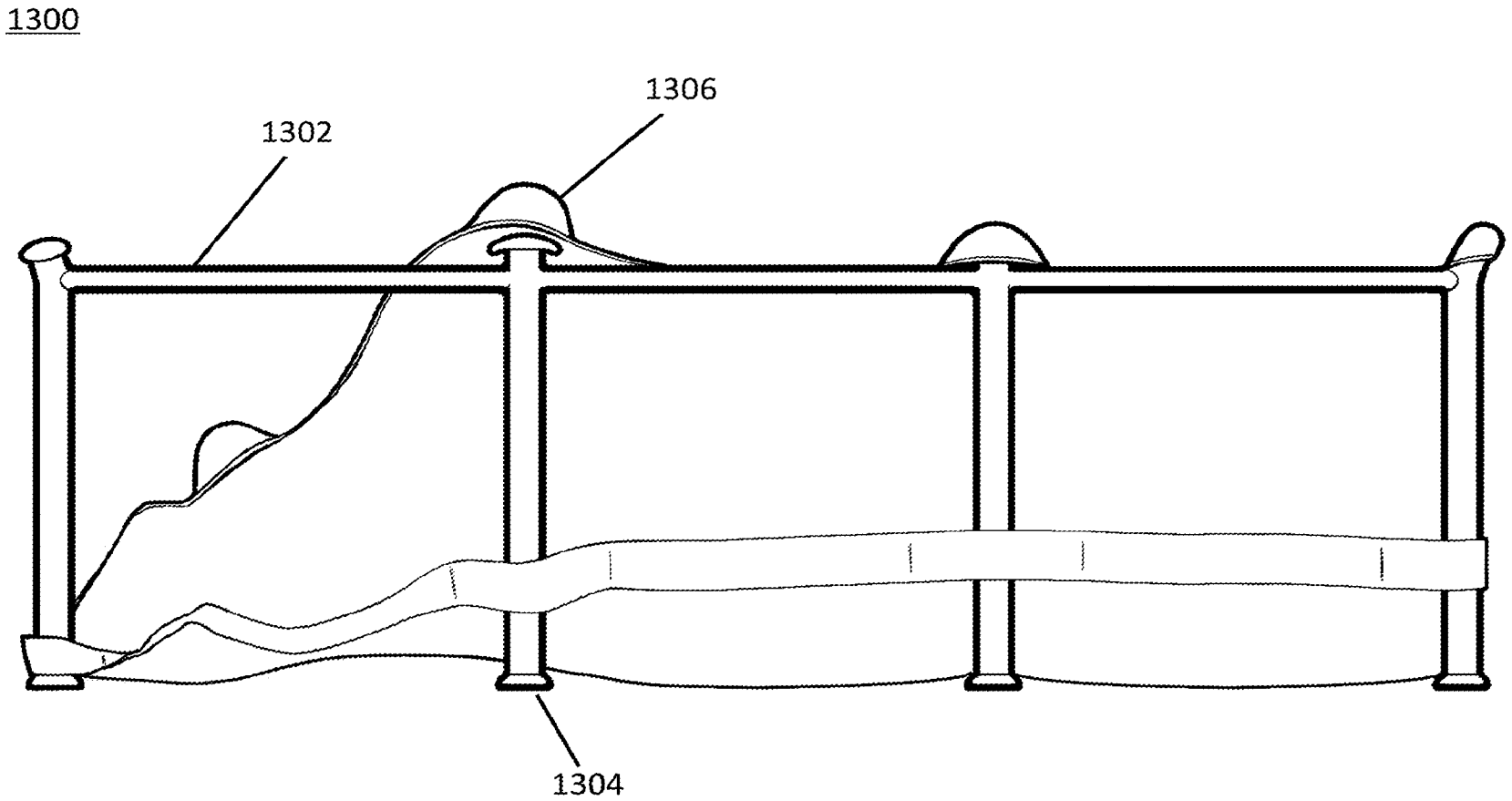
FIGS. 13A-13D illustrate exemplary embodiments of pool liner connections.

FIG. 13A shows an exemplary embodiment of pool 1300. Pool 1300 may comprise horizontal frame members 1302, vertical frame members 1304, and pool liner 1306. Pool liner 1306 may include one or more pockets to attach to one or more vertical frame members 1304.

Figure 13B:
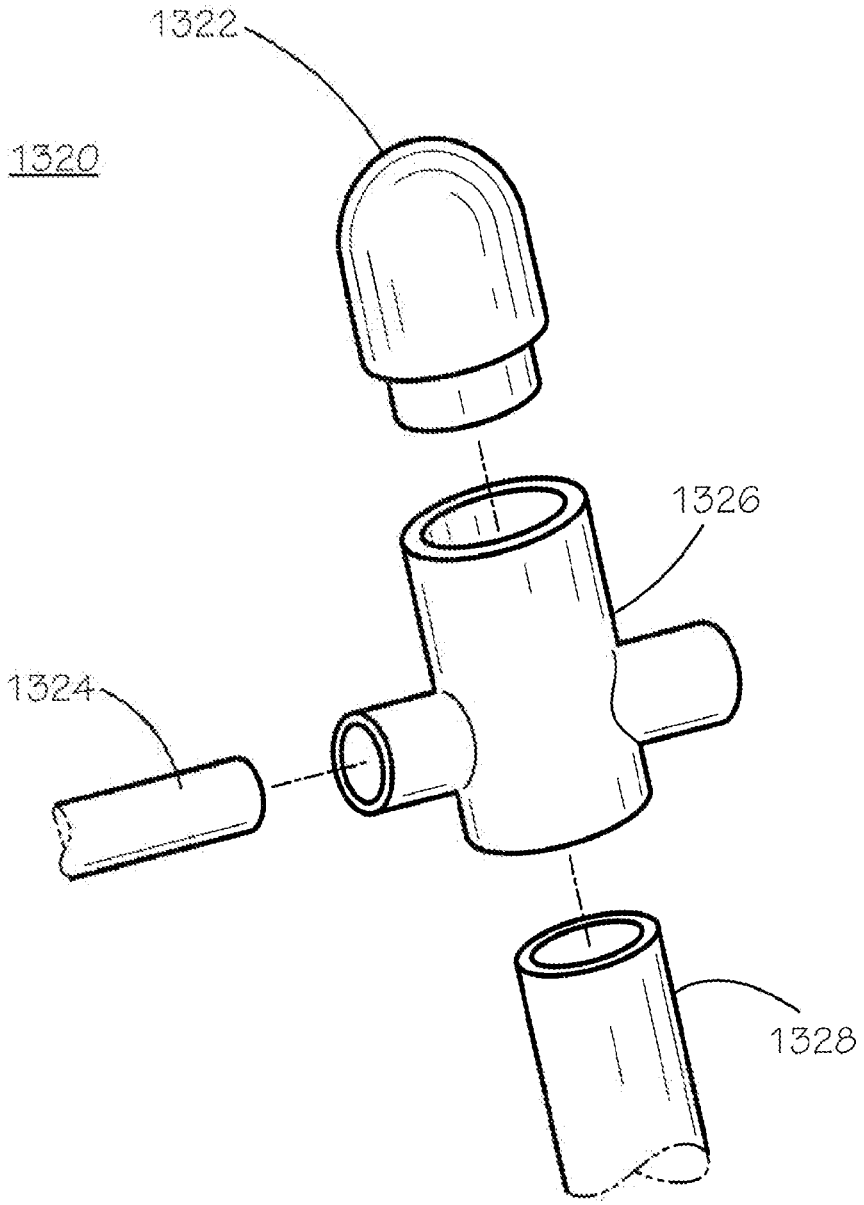

FIG. 13B shows an exemplary embodiment of a portion of pool 1300. Pool frame assembly 1320 may comprise horizontal frame member 1324, frame connector 1326, vertical frame member 1328, and cap 1322. Vertical frame member 1328 may be attachable to one or more of frame connector 1326 and/or cap 1322. Frame connector 1326 may connect to one or more horizontal frame members (e.g., horizontal frame member 1324). Cap 1322 may be attachable to a top portion of frame connector 1326. Cap 1322 may be configured to be attached to frame connector 1326 via welding. Although it is contemplated that welding may be used in this example, other methods of connecting a cap to a mating member are known to those of skill in the art and contemplated herein and may be used in addition to or in the alternative of welding. Such connections may include a threaded, pinned, adhesive, and/or press fit connection, or another connection type contemplated herein.

Figure 13C:
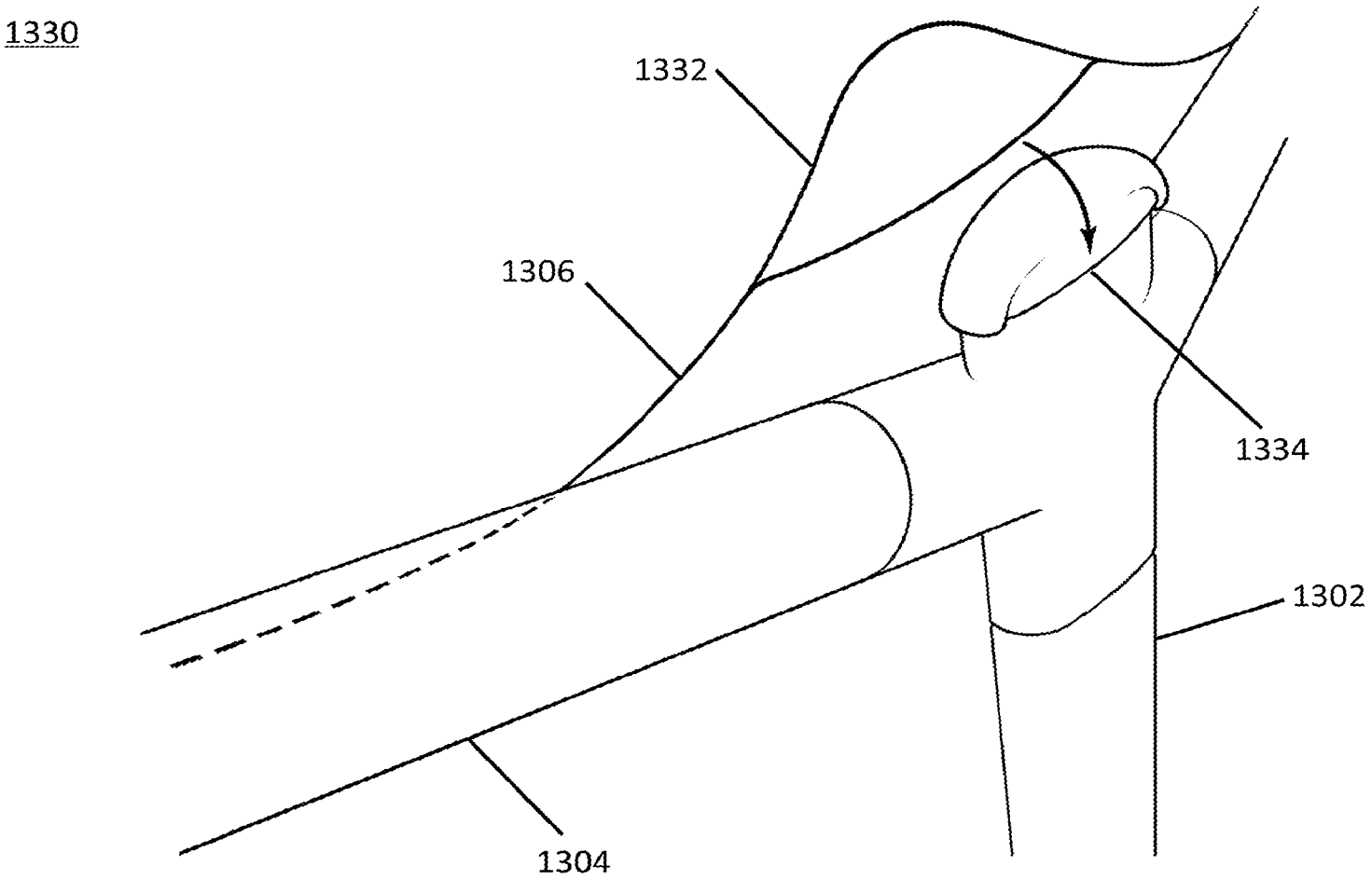

FIG. 13C shows an exemplary embodiment of a portion of pool 1300. Pool frame assembly 1320 may comprise cap 1334. Cap 1334 may comprise a wedge-shape. Liner 1306 may comprise pocket 1332. Pocket 1332 may be configured to attach liner 1306 to cap 1334. Pocket 1332 may be sewn onto liner 1306. It is also contemplated that cap 1334 may be attachable to a horizontal frame member.

Figure 13D:
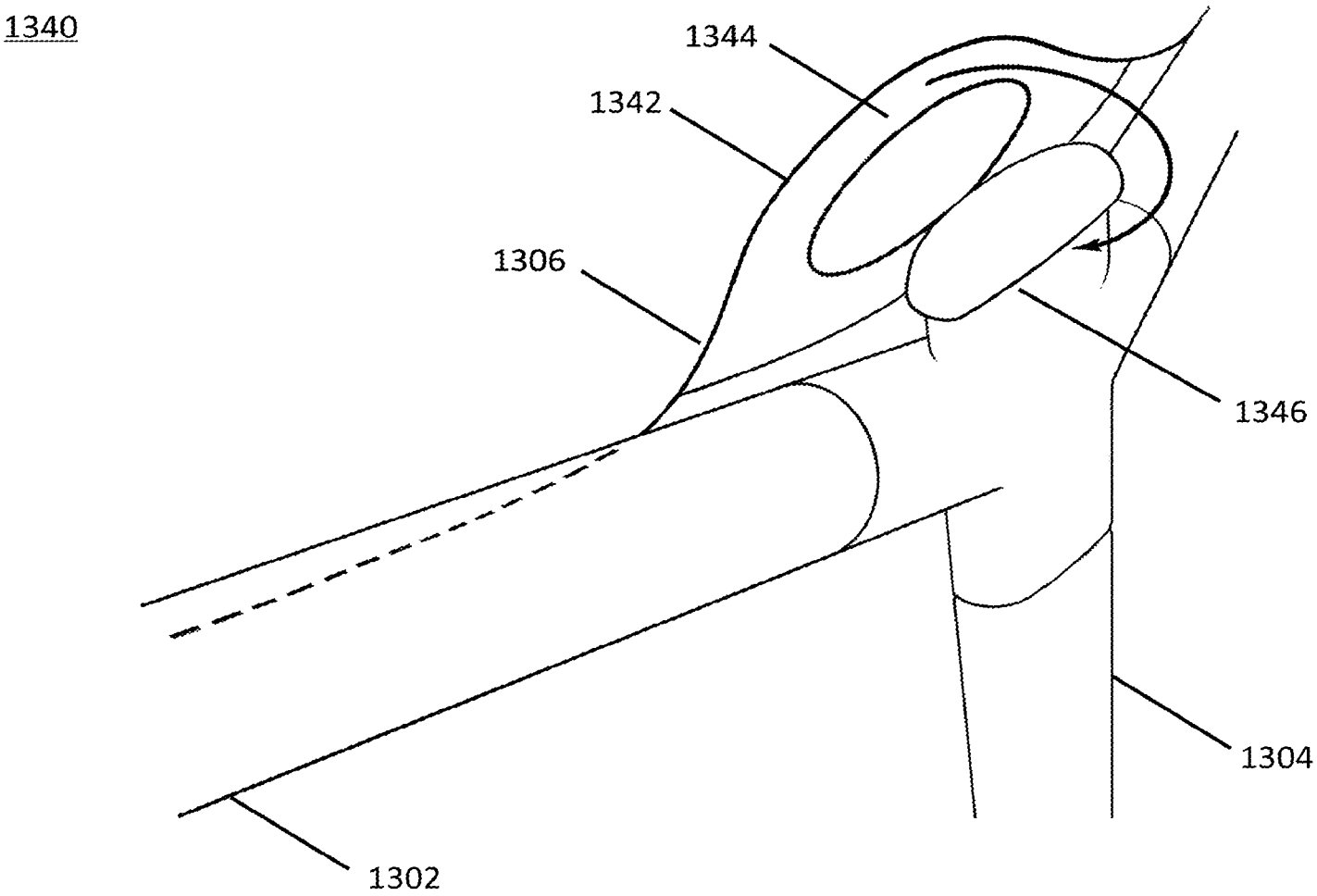

FIG. 13D shows an exemplary embodiment of a portion of pool 1300. Pool frame assembly 1340 may comprise flap attachment 1342, flap aperture 1344, and cap 1346. Cap 1346 may comprise a wedge-shape. Liner 1306 may comprise flap attachment 1342. Flap attachment 1342 may comprise flap aperture 1344. Flap aperture 1344 may be configured to attach liner 1306 to cap 1346. Flap aperture 1344 may comprise a reinforced portion around flap aperture 1344.

Figure 14:
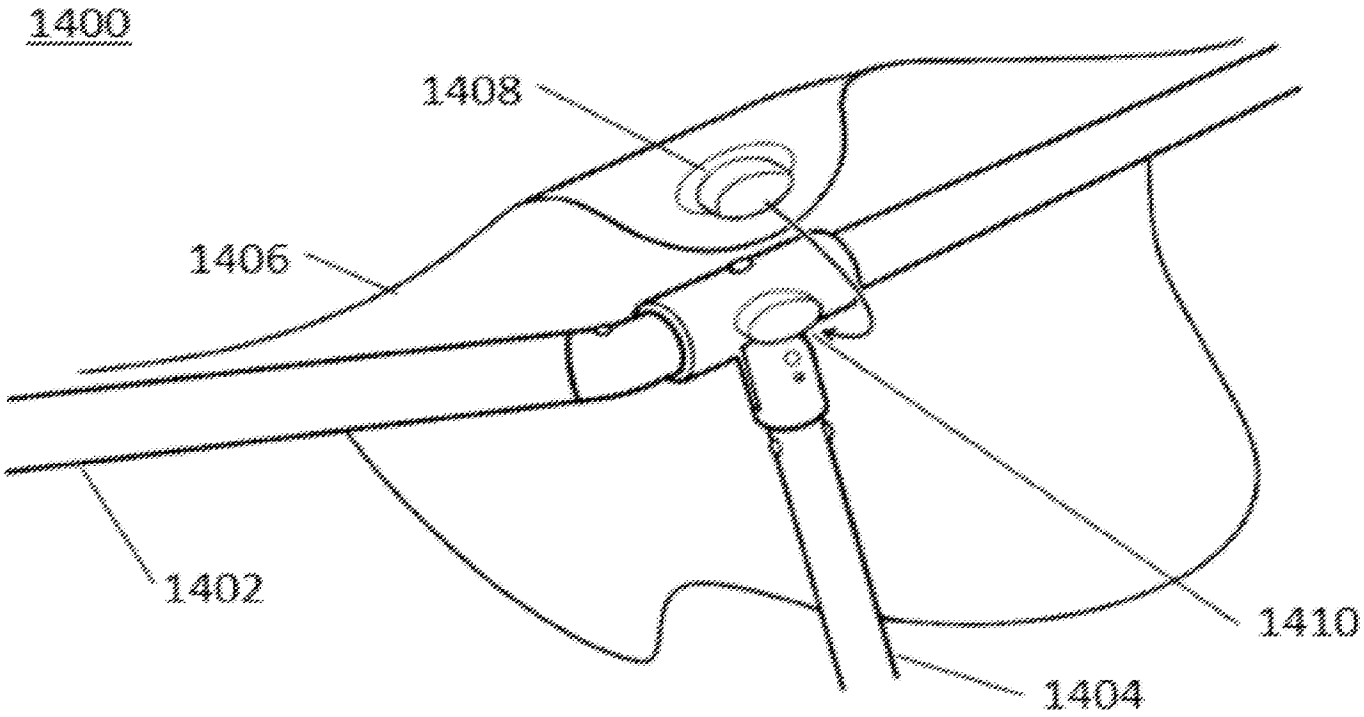
FIG. 14 illustrates an exemplary embodiment of a pool liner connector.
Figure 15:
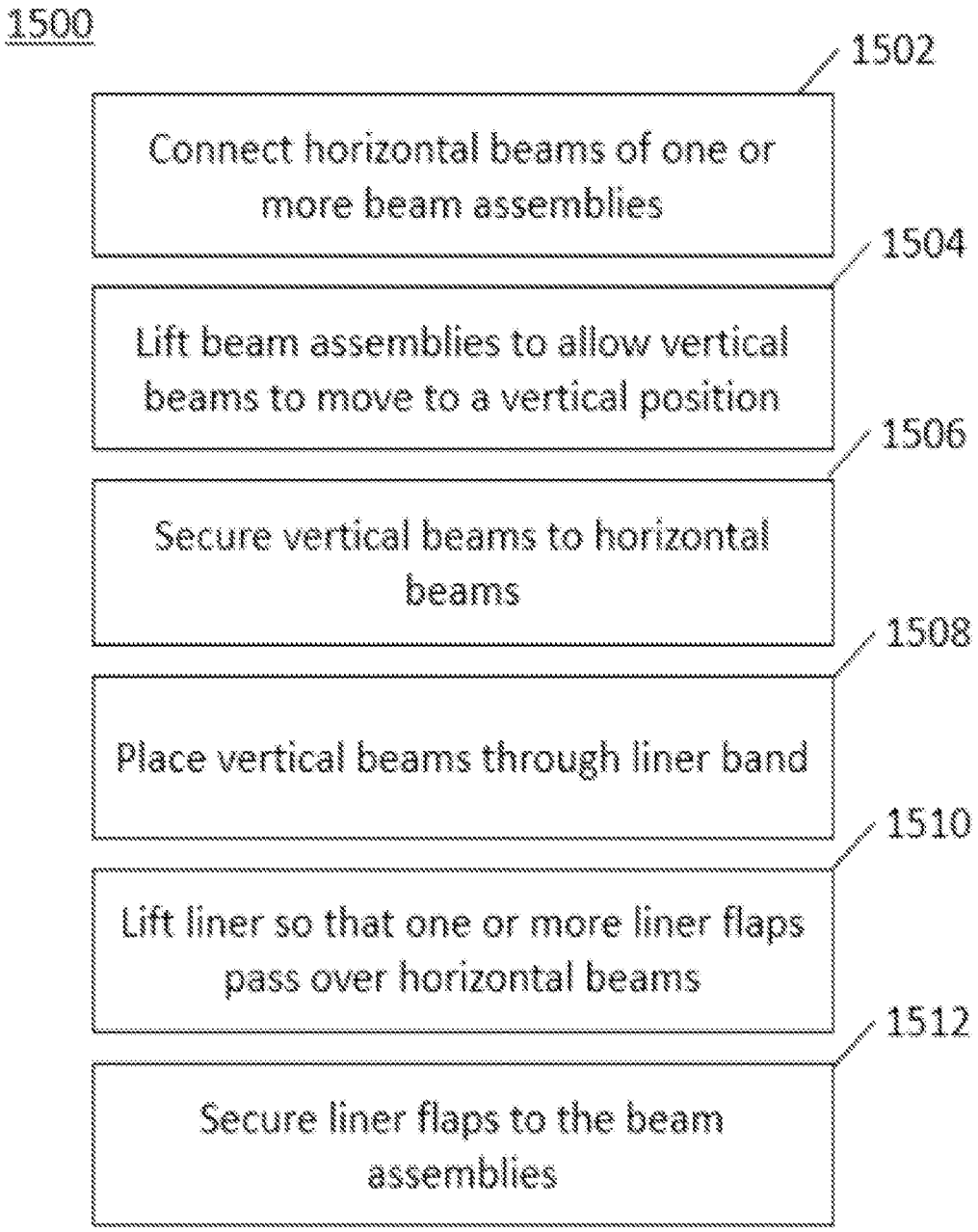
FIG. 15 illustrates an exemplary method of assembling a pool.

FIG. 14 shows an exemplary embodiment of a portion of pool 1400. Pool 1400 may comprise horizontal frame member 1402, vertical frame member 1404, liner 1406, liner attachment 1408, and protrusion 1410. Protrusion 1410 may comprise a frame connector that connects one or more horizontal frame member with one or more vertical frame members. In some embodiments, protrusion 1410 may include features discussed above with reference to frame insert 300 with reference to FIGS. 3A-3B or other frame inserts disclosed herein. In some embodiments, it is contemplated that one or more frame members may attach to one or more other frame members consistent with embodiments discussed herein, for example, with reference to FIGS. 2A-2C, 3A-3B, 4, 5A-5B, 6A-6B, and 7A-7C. Liner 1406 may include a flap with flap attachment features consistent with embodiments discussed herein, for example, with reference to 10A, 10E, 10K, and 11B-11F, FIGS. 13C-13D.

FIG. 15 shows an exemplary embodiment of a method of assembling a pool 1500. Method of assembly a pool 1500 may comprise a step 1502 of connecting horizontal beams of one or more assemblies. For example, horizontal beams may be connected via one or more frame inserts consistent with the disclosure herein. Method of assembly a pool 1500 may comprise a step 1504 of lifting beam assemblies to allow vertical beams to move to a vertical position. Method of assembly a pool 1500 may comprise a step 1506 of securing vertical beams to horizontal beams. For example, frame inserts may be used consistent with the disclosure herein. As another example, one or more frame members may comprise attachment features consistent with the disclosure herein. Method of assembly a pool 1500 may comprise a step 1508 of placing the one or more vertical beams through one or more liner bands. Liner bands may be similar to the band discussed above with respect to FIG. 1A. Method of assembly a pool 1500 may comprise a step 1510 of lifting a pool liner so that one or more liner flaps pass over the one or more horizontal beams. Method of assembly a pool 1500 may comprise a step 1512 of securing the one or more liner flaps to the one or more beam assemblies. For example, the one or more liner flaps may be attachable to the one or more beam assemblies consistent with the disclosure herein, for example, with reference to 10A, 10E, 10K, and 11B-11F, FIGS. 13C-13D.

Consistent with disclosed embodiments, installing and/or constructing a pool may include steps and/or an order of steps. Although steps and the order of steps are contemplated, the steps may be combined, omitted, reordered, and/or integrated into other processes to perform the tasks contemplated herein.

It is understood that while certain embodiments are discussed to facilitate understanding of various principles and aspects of this disclosure, the embodiments are not described in isolation and the descriptions are not necessarily mutually exclusive. Thus, it is contemplated and understood that described features of principles of any embodiment may be incorporated into other embodiments.

It will be apparent to those skilled in the art that various modifications and variations can be made to the disclosed pool, pool liner, frame members, and connections. While illustrative embodiments have been described herein, the scope of the invention includes any and all embodiments having equivalent elements, modifications, omissions, combinations (e.g., of aspects across various embodiments), adaptations and/or alterations as would be appreciated by those skilled in the art based on the present disclosure. The limitations in the claims are to be interpreted broadly based on the language employed in the claims and not limited to examples described in the present specification or during the prosecution of the application, which examples are to be construed as non-exclusive. It is intended, therefore, that the specification and examples be considered as exemplary only, with a true scope and spirit of the invention being indicated by the following claims and their full scope of equivalents.

What is claimed is:

1. A pool frame comprising:

a plurality of frame links, wherein each frame link comprises:

a first frame member;

a second frame member;

a pivot connection between the first frame member and the second frame member, wherein the first frame member is configured to move from a first position substantially parallel with the second frame member to a second position substantially non-parallel with the second frame member, and wherein the pivot connection comprises a locking tab configured to secure the second frame member relative to the first frame member; and a frame insert configured to lock the first frame member in a position relative to the second frame member.

2. The pool frame of claim 1, wherein a portion of the frame insert is configured to slide within the first frame member to lock it relative to the second frame member.

3. The pool frame of claim 1, wherein the first frame member rests on the second frame member when the second frame member is in a substantially vertical position.

4. The pool frame of claim 1, wherein the frame insert comprises an angle between the first frame member and the second frame member.

5. The pool frame of claim 1, wherein a portion of the first frame member of the first link is configured to be placed within a receptacle of the frame insert.

6. A pool comprising:

a frame including one or more frame members; and a pool liner including one or more flaps, wherein the pool liner extends from below one or more frame members to above and around one or more frame members;

wherein one or more flaps comprises an attachment aperture and one or more frame members comprises a protruding portion;

wherein the attachment aperture of one or more flaps is configured to attach to the protruding portion of one or more frame members.

7. The pool of claim 6, wherein the pool liner is configured to attach to itself after passing above and around one or more frame members.

8. The pool of claim 6, wherein the pool liner is configured to attach to a vertical member of the one or more frame members.

9. The pool of claim 6, wherein the pool liner is configured to attach to a horizontal member of the one or more frame members.

10. The pool of claim 6, wherein the pool liner is configured to attach to a protrusion of a horizontal member of the one or more frame members.

11. A pool comprising:

a frame including one or more vertical frame members and at least one horizontal frame member; and a pool liner including one or more pockets, wherein the pool liner extends from below the at least one horizontal frame member to above the at least one horizontal frame member;

wherein a plurality of pockets are spaced along a circumference of the pool liner;

wherein each of the plurality of pockets are configured to receive and retain an end of a vertical frame member of the one or more vertical frame members.

12. The pool of claim 11, wherein one pocket of the one or more pockets is positioned on a flap of the pool liner.

13. The pool of claim 11, wherein the one or more vertical members each comprises a cap.

14. The pool of claim 13, wherein the cap is configured to fit within one pocket of the plurality of pockets.

15. The pool of claim 14, wherein the cap comprises a wedge-shape.

16. A method for constructing a pool, the steps comprising:

connecting horizontal beams of one or more beam assemblies;

lifting the one or more beam assemblies to allow one or more vertical beams of the beam assemblies to move to a substantially vertical position, wherein the beam assemblies comprise a connector that allows movement of the one or more vertical beams relative to the one or more horizontal beams;

lifting one or more liner flaps of a pool liner above the one or more horizontal beams; and securing the one or more liner flaps to the one or more beam assemblies.

17. The method of claim 16, further comprising a step of securing the one or more vertical beams to the one or more horizontal beams.

18. The method of claim 16, the step of securing the one or more liner flaps to the one or more beam assemblies comprises attaching the one or more liner flaps to one or more horizontal beams.

19. The method of claim 16, the step of securing the one or more liner flaps to the one or more beam assemblies comprises attaching the one or more liner flaps to one or more vertical beams.

20. A pool frame comprising:

a plurality of frame links, wherein each frame link comprises:

a first frame member;

a second frame member;

a pivot connection between the first frame member and the second frame member, wherein the first frame member is configured to move from a first position substantially parallel with the second frame member to a second position substantially non-parallel with the second frame member; and a frame insert configured to lock the first frame member in a position relative to the second frame member, wherein a portion of the first frame member of the first link is configured to be placed within a receptacle of the frame insert.

* * * * *